US006774867B2

(12) United States Patent
Diaz et al.

(10) Patent No.: US 6,774,867 B2
(45) Date of Patent: Aug. 10, 2004

(54) MULTI-RESONANT, HIGH-IMPEDANCE ELECTROMAGNETIC SURFACES

(75) Inventors: Rodolfo E. Diaz, Phoenix, AZ (US); William E. McKinzie, III, Fulton, MD (US)

(73) Assignee: E-Tenna Corporation, Laurel, MD (US)

( * ) Notice: Subject to any disclaimer, the term of this patent is extended or adjusted under 35 U.S.C. 154(b) by 0 days.

(21) Appl. No.: 10/327,842

(22) Filed: Dec. 23, 2002

(65) Prior Publication Data

US 2003/0122729 A1 Jul. 3, 2003

Related U.S. Application Data

(63) Continuation of application No. 09/678,128, filed on Oct. 4, 2000, now Pat. No. 6,512,494.

(51) Int. Cl.[7] ..... H01Q 15/02
(52) U.S. Cl. ..... 343/909; 343/700 MS
(58) Field of Search ..... 343/909, 770, 343/767, 748, 788, 842, 866, 911 R, 700 MS; H01Q 15/02

(56) References Cited

U.S. PATENT DOCUMENTS

| | | | | | |
|---|---|---|---|---|---|
| 5,917,458 | A | * | 6/1999 | Ho et al. | 343/909 |
| 6,075,485 | A | * | 6/2000 | Lilly et al. | 343/700 MS |
| 6,218,978 | B1 | * | 4/2001 | Simpkin et al. | 342/5 |
| 6,232,931 | B1 | * | 5/2001 | Hart | 343/909 |
| 6,323,825 | B1 | * | 11/2001 | Zidek et al. | 343/872 |
| 6,512,494 | B1 | * | 1/2003 | Diaz et al. | 343/909 |

FOREIGN PATENT DOCUMENTS

| | | | | |
|---|---|---|---|---|
| WO | WO-99/50929 | * | 10/1999 | H01Q/1/38 |

* cited by examiner

*Primary Examiner*—Don Wong
*Assistant Examiner*—Trinh Vo Dinh
(74) *Attorney, Agent, or Firm*—Brinks Hofer Gilson & Lione

(57) ABSTRACT

An artificial magnetic conductor is resonant at multiple resonance frequencies. The artificial magnetic conductor is characterized by an effective media model which includes a first layer and a second layer. Each layer has a layer tensor permittivity and a layer tensor permeability having non-zero elements on the main tensor diagonal only.

2 Claims, 15 Drawing Sheets

TE Mode propagating in the x direction:

TM Mode propagating in the x direction:

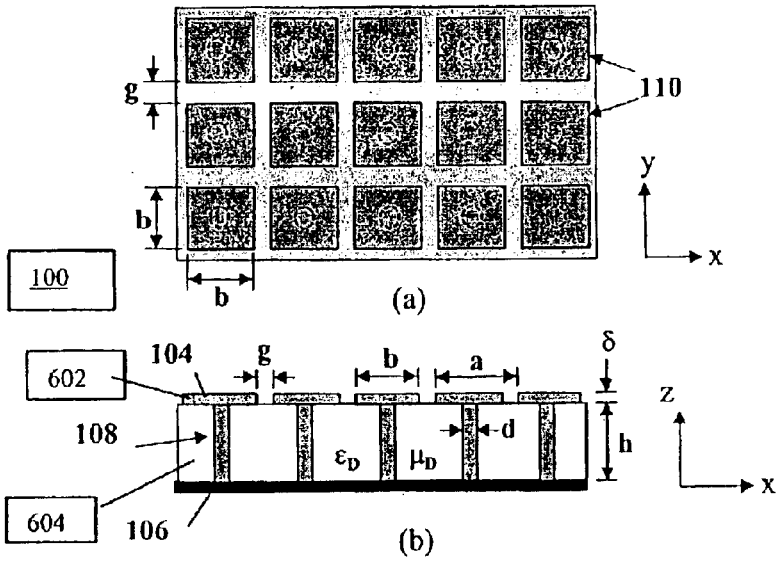

FIG. 6 (Prior Art)

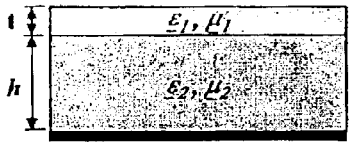

$$\underline{\varepsilon_i} = \varepsilon_o \begin{pmatrix} \varepsilon_{ix} & 0 & 0 \\ 0 & \varepsilon_{iy} & 0 \\ 0 & 0 & \varepsilon_{iz} \end{pmatrix} \qquad \underline{\mu_i} = \mu_o \begin{pmatrix} \mu_{ix} & 0 & 0 \\ 0 & \mu_{iy} & 0 \\ 0 & 0 & \mu_{iz} \end{pmatrix}$$

Upper Layer:

$$\varepsilon_{1x} = \varepsilon_{1y} = \varepsilon_{avg} \frac{2b}{\pi t} \ln\left(\frac{2b}{\pi g}\right)$$

$$\varepsilon_{1z} = 1$$

$$\mu_{1x} = \mu_{1y} = 1$$

$$\mu_{1z} = 2\frac{\varepsilon_{avg}}{\varepsilon_{1y}} << 1$$

where $\varepsilon_{avg} = \dfrac{1+\varepsilon_D}{2}$

Lower Layer:

$$\varepsilon_{2x} = \varepsilon_{2y} = \varepsilon_D\left(\frac{1+\alpha}{1-\alpha}\right) \qquad \mu_{2x} = \mu_{2y} = \frac{\varepsilon_D}{\varepsilon_{2x}}\mu_D$$

$$\varepsilon_{2z} = \varepsilon_D - \frac{1}{\omega^2 \varepsilon_0 \dfrac{\mu_D \mu_o A}{4\pi}\left[\ln\left(\dfrac{1}{\alpha}\right) + \alpha - 1\right]} \qquad \mu_{2z} = (1-\alpha)\mu_D$$

where $\alpha = \dfrac{\text{Cross sectional area of each via}}{\text{Area of the unit cell for the rodded media}}$ $\varepsilon_D$ = Relative permittivity of the background dielectric $\mu_D$ = Relative permeability of the background dielectri

FIG. 7

MULTI-RESONANT, HIGH-IMPEDANCE ELECTROMAGNETIC SURFACES

CROSS REFERENCE TO RELATED APPLICATIONS

This application is a continuation of application Ser. No. 09/678,128 filed Oct. 4, 2000 now U.S. Pat. No. 6,512,494, which is hereby incorporated by reference herein.

BACKGROUND

The present invention relates generally to high-impedance surfaces. More particularly, the present invention relates to a multi-resonant, high-impedance electromagnetic surface.

A high impedance surface is a lossless, reactive surface whose equivalent surface impedance, $$Z_s = \frac{E_{tan}}{H_{tan}},$$

approximates an open circuit and which inhibits the flow of equivalent tangential electric surface current, thereby approximating a zero tangential magnetic field, $H_{tan} \approx 0$. $E_{tan}$ and $H_{tan}$ are the electric and magnetic fields, respectively, tangential to the surface. High impedance surfaces have been used in various antenna applications. These applications range from corrugated horns which are specially designed to offer equal E and H plane half power beamwidths to traveling wave antennas in planar or cylindrical form. However, in these applications, the corrugations or troughs are made of metal where the depth of the corrugations is one quarter of a free space wavelength, $\lambda/4$, where $\lambda$ is the wavelength at the frequency of interest. At high microwave frequencies, $\lambda/4$ is a small dimension, but at ultra-high frequencies (UHF, 300 MHz to 1 GHz), or even at low microwave frequencies (1–3 GHz), $\lambda/4$ can be quite large. For antenna applications in these frequency ranges, an electrically-thin ($\lambda/100$ to $\lambda/50$ thick) and physically thin high impedance surface is desired.

One example of a thin high-impedance surface is disclosed in D. Sievenpiper, "High-impedance electromagnetic surfaces," Ph.D. dissertation, UCLA electrical engineering department, filed January 1999, and in PCT Patent Application number PCT/US99/06884. This high impedance surface 100 is shown in FIG. 1. The high-impedance surface 100 includes a lower permittivity spacer layer 104 and a capacitive frequency selective surface (FSS) 102 formed on a metal backplane 106. Metal vias 108 extend through the spacer layer 104, and connect the metal backplane to the metal patches of the FSS layer. The thickness h of the high impedance surface 100 is much less than $\lambda/4$ at resonance, and typically on the order of $\lambda/50$, as indicated in FIG. 1.

The FSS 102 of the prior art high impedance surface 100 is a periodic array of metal patches 110 which are edge coupled to form an effective sheet capacitance. This is referred to as a capacitive frequency selective surface (FSS). Each metal patch 110 defines a unit cell which extends through the thickness of the high impedance surface 100. Each patch 110 is connected to the metal backplane 106, which forms a ground plane, by means of a metal via 108, which can be plated through holes. The periodic array of metal vias 108 has been known in the prior art as a rodded media, so these vias are sometimes referred to as rods or posts. The spacer layer 104 through which the vias 108 pass is a relatively low permittivity dielectric typical of many printed circuit board substrates. The spacer layer 104 is the region occupied by the vias 108 and the low permittivity dielectric. The spacer layer is typically 10 to 100 times thicker than the FSS layer 102. Also, the dimensions of a unit cell in the prior art high-impedance surface are much smaller than $\lambda$ at the fundamental resonance. The period is typically between $\lambda/40$ and $\lambda/12$.

A frequency selective surface is a two-dimensional array of periodically arranged elements which may be etched on, or embedded within, one or multiple layers of dielectric laminates. Such elements may be either conductive dipoles, patches, loops, or even slots. As a thin periodic structure, it is often referred to as a periodic surface.

Frequency selective surfaces have historically found applications in out-of-band radar cross section reduction for antennas on military airborne and naval platforms. Frequency selective surfaces are also used as dichroic subreflectors in dual-band Cassegrain reflector antenna systems. In this application, the subreflector is transparent at frequency band $f_1$ and opaque or reflective at frequency band $f_2$. This allows one to place the feed horn for band $f_1$ at the focal point for the main reflector, and another feed horn operating at $f_2$ at the Cassegrain focal point. One can achieve a significant weight and volume savings over using two conventional reflector antennas, which is critical for space-based platforms.

The prior art high-impedance surface 100 provides many advantages. The surface is constructed with relatively inexpensive printed circuit technology and can be made much lighter than a corrugated metal waveguide, which is typically machined from a block of aluminum. In printed circuit form, the prior art high-impedance surface can be 10 to 100 times less expensive for the same frequency of operation. Furthermore, the prior art surface offers a high surface impedance for both x and y components of tangential electric field, which is not possible with a corrugated waveguide. Corrugated waveguides offer a high surface impedance for one polarization of electric field only. According to the coordinate convention used herein, a surface lies in the xy plane and the z-axis is normal or perpendicular to the surface. Further, the prior art high-impedance surface provides a substantial advantage in its height reduction over a corrugated metal waveguide, and may be less than one-tenth the thickness of an air-filled corrugated metal waveguide.

A high-impedance surface is important because it offers a boundary condition which permits wire antennas conducting electric currents to be well matched and to radiate efficiently when the wires are placed in very close proximity to this surface (e.g., less than $\lambda/100$ away). The opposite is true if the same wire antenna is placed very close to a metal or perfect electric conductor (PEC) surface. The wire antenna/PEC surface combination will not radiate efficiently due to a very severe impedance mismatch. The radiation pattern from the antenna on a high-impedance surface is confined to the upper half space, and the performance is unaffected even if the high-impedance surface is placed on top of another metal surface. Accordingly, an electrically-thin, efficient antenna is very appealing for countless wireless devices and skin-embedded antenna applications.

FIG. 2 illustrates electrical properties of the prior art high-impedance surface. FIG. 2(*a*) illustrates a plane wave normally incident upon the prior art high-impedance surface 100. Let the reflection coefficient referenced to the surface be denoted by $\Gamma$. The physical structure shown in FIG. 2(*a*) has an equivalent transverse electro-magnetic mode transmission line shown in FIG. 2(*b*). The capacitive FSS 102 (FIG. 1) is modeled as a shunt capacitance C and the spacer layer 104 is modeled as a transmission line of length h which is terminated in a short circuit corresponding to the backplane 106. FIG. 2(*c*) shows a Smith chart in which the short is transformed into the stub impedance $Z_{stub}$ just below the FSS layer 102. The admittance of this stub line is added to the capacitive susceptance to create a high impedance $Z_{in}$ at the outer surface. Note that the $Z_{in}$ locus on the Smith Chart in FIG. 2(*c*) will always be found on the unit circle since our model is ideal and lossless. So Γ has an amplitude of unity.

The reflection coefficient Γ has a phase angle θ which sweeps from 180° at DC, through 0° at the center of the high impedance band, and rotates into negative angles at higher frequencies where it becomes asymptotic to −180°. This is illustrated in FIG. 2(*d*). Resonance is defined as that frequency corresponding to 0° reflection phase. Herein, the reflection phase bandwidth is defined as that bandwidth between the frequencies corresponding to the +90° and −90° phases. This reflection phase bandwidth also corresponds to the range of frequencies where the magnitude of the surface reactance exceeds the impedance of free space: $|X| \geqq \eta_o = 377$ ohms.

A perfect magnetic conductor (PMC) is a mathematical boundary condition whereby the tangential magnetic field on this boundary is forced to be zero. It is the electromagnetic dual to a perfect electric conductor (PEC) upon which the tangential electric field is defined to be zero. A PMC can be used as a mathematical tool to create simpler but equivalent electromagnetic problems for slot antenna analysis. PMCs do not exist except as mathematical artifacts. However, the prior art high-impedance surface is a good approximation to a PMC over a limited band of frequencies defined by the +/−90° reflection phase bandwidth. So in recognition of its limited frequency bandwidth, the prior art high-impedance surface is referred to herein as an example of an artificial magnetic conductor, or AMC.

The prior art high-impedance surface offers reflection phase resonances at a fundamental frequency, plus higher frequencies approximated by the condition where the electrical thickness of the spacer layer, βh, in the high-impedance surface 100 is nπ, where n is an integer. These higher frequency resonances are harmonically related and hence uncontrollable. If the prior art AMC is to be used in a dual-band antenna application where the center frequencies are separated by a frequency range of, say 1.5:1, we would be forced to make a very thick AMC. Assuming a non-magnetic spacer layer ($\mu_D$=1) the thickness h must be h=λ/14 to achieve at least a 50% fractional frequency bandwidth where both center frequencies would be contained in the reflection phase bandwidth. Alternatively, magnetic materials could be used to load the spacer layer, but this is a topic of ongoing research and nontrivial expense. Accordingly, there is a need for a class of AMCs which exhibit multiple reflection phase resonances, or multi-band performance, that are not harmonically related, but at frequencies which may be prescribed.

BRIEF SUMMARY

By way of introduction only, in a first aspect, an artificial magnetic conductor (AMC) resonant at multiple resonance frequencies is characterized by an effective media model which includes a first layer and a second layer. Each layer has a layer tensor permittivity and a layer tensor permeability. Each layer tensor permittivity and each layer tensor permeability has non-zero elements on their main diagonal only, with the x and y tensor directions being in-plane with each respective layer and the z tensor direction being normal to each layer.

In another aspect, an artificial magnetic conductor operable over at least a first high-impedance frequency band and a second high-impedance frequency band as a high-impedance surface is defined by an effective media model which includes a spacer layer and a frequency selective surface (FSS) disposed adjacent the spacer layer. The FSS has a transverse permittivity $\epsilon_{1t}$ defined by $$\varepsilon_{1x} = \varepsilon_{1y} = \frac{Y(\omega)}{j\omega\varepsilon_0 t},$$

wherein Y(ω) is a frequency dependent admittance function for the frequency selective surface, j is the imaginary operator, ω corresponds to angular frequency, $\epsilon_o$ is the permittivity of free space, and t corresponds to thickness of the frequency selective surface.

In another aspect, an artificial magnetic conductor (AMC) resonant with a substantially zero degree reflection phase over two or more resonant frequency bands, includes a spacer layer including an array of metal posts extending through the spacer layer and a frequency selective surface disposed on the spacer layer. The frequency selective surface, as an effective media, has one or more Lorentz resonances at predetermined frequencies different from the two or more resonant frequency bands.

In a further aspect, an artificial magnetic conductor (AMC) resonant with a substantially zero degree reflection phase over at least two resonant frequency bands includes a frequency selective surface having a plurality of Lorentz resonances in transverse permittivity at independent, non-harmonically related, predetermined frequencies different from the resonant frequency bands.

The foregoing summary has been provided only by way of introduction. Nothing in this section should be taken as a limitation on the following claims, which define the scope of the invention.

BRIEF DESCRIPTION OF THE DRAWINGS

FIG. 6 illustrates top and cross sectional views of a prior art high impedance surface;

FIG. 7 presents a new effective media model for the prior art high-impedance surface of FIG. 6;

DETAILED DESCRIPTION OF THE PRESENTLY PREFERRED EMBODIMENTS

A planar, electrically-thin, anisotropic material is designed to be a high-impedance surface to electromagnetic waves. It is a two-layer, periodic, magnetodielectric structure where each layer is engineered to have a specific tensor permittivity and permeability behavior with frequency. This structure has the properties of an artificial magnetic conductor over a limited frequency band or bands, whereby, near its resonant frequency, the reflection amplitude is near unity and the reflection phase at the surface lies between +/−90 degrees. This engineered material also offers suppression of transverse electric (TE) and transverse magnetic (TM) mode surface waves over a band of frequencies near where it operates as a high impedance surface. The high impedance surface provides substantial improvements and advantages. Advantages include a description of how to optimize the material's effective media constituent parameters to offer multiple bands of high surface impedance. Advantages further include the introduction of various embodiments of conducting loop structures into the engineered material to exhibit multiple reflection-phase resonant frequencies. Advantages still further include a creation of a high-impedance surface exhibiting multiple reflection-phase resonant frequencies without resorting to additional magnetodielectric layers.

This high-impedance surface has numerous antenna applications where surface wave suppression is desired, and where physically thin, readily attachable antennas are desired. This includes internal antennas in radiotelephones and in precision GPS antennas where mitigation of multipath signals near the horizon is desired.

An artificial magnetic conductor (AMC) offers a band of high surface impedance to plane waves, and a surface wave bandgap over which bound, guided transverse electric (TE) and transverse magnetic (TM) modes cannot propagate. TE and TM modes are surface waves moving transverse or across the surface of the AMC, in parallel with the plane of the AMC. The dominant TM mode is cut off and the dominant TE mode is leaky in this bandgap. The bandgap is a band of frequencies over which the TE and TM modes will not propagate as bound modes.

Figure 3:
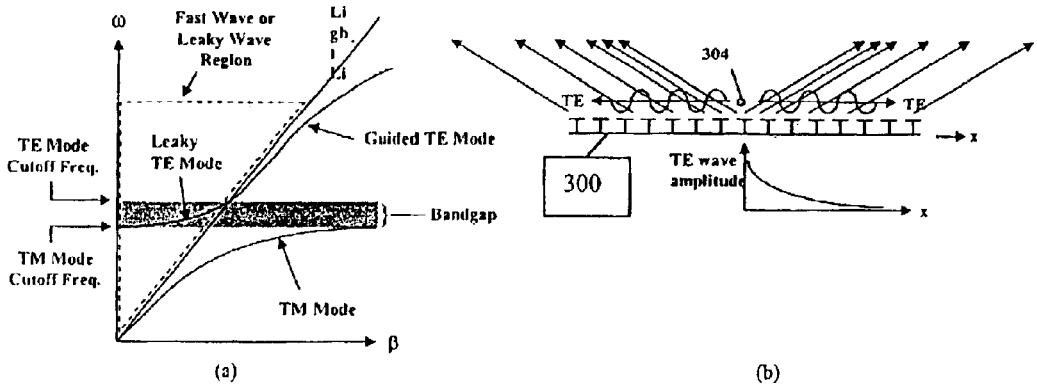
FIG. 3 is a diagram illustrating surface wave properties of an artificial magnetic conductor.

FIG. 3 illustrates surface wave properties of an AMC 300 in proximity to an antenna or radiator 304. FIG. 3(*a*) is an $\omega-\beta$ diagram for the lowest order TM and TE surface wave modes which propagate on the AMC 300. Knowledge of the bandgap over which bound TE and TM waves cannot propagate is very critical for antenna applications of an AMC because it is the radiation from the unbound or leaky TE mode, excited by the wire antenna 304 and the inability to couple into the TM mode that makes bent-wire monopoles, such as the antenna 304 on the AMC 300, a practical antenna element. The leaky TE mode occurs at frequencies only within the bandgap.

FIG. 3(*b*) is a cross sectional view of the AMC 300 showing TE waves radiating from the AMC 300 as leaky waves. Leakage is illustrated by the exponentially increasing spacing between the arrows illustrating radiation from the surface as the waves radiate power away from the AMC 300 near the antenna 304. Leakage of the surface wave dramatically reduces the diffracted energy from the edges of the AMC surface in antenna applications. The radiation pattern from small AMC ground planes can therefore be substantially confined to one hemisphere, the hemisphere above the front or top surface of the AMC 300. The front or top surface is the surface proximate the antenna 304. The hemisphere below or behind the AMC 300, below the rear or bottom surface of the AMC 300, is essentially shielded from radiation. The rear or bottom surface of the AMC 300 is the surface away from the antenna 304.

Figure 4:
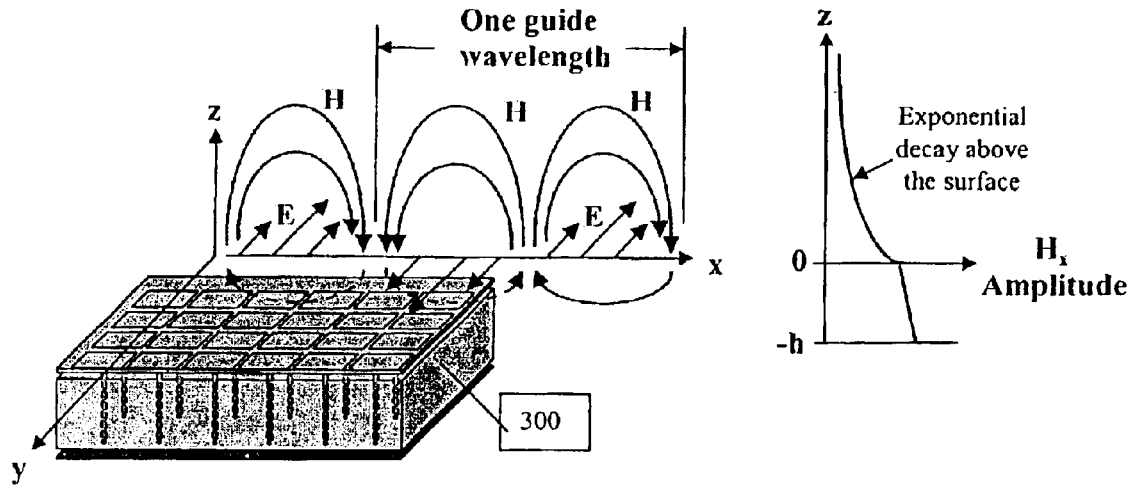
FIG. 4 illustrates electromagnetic fields of a TE mode surface wave propagating in the x direction in the artificial magnetic conductor of FIG. 3.
Figure 5:
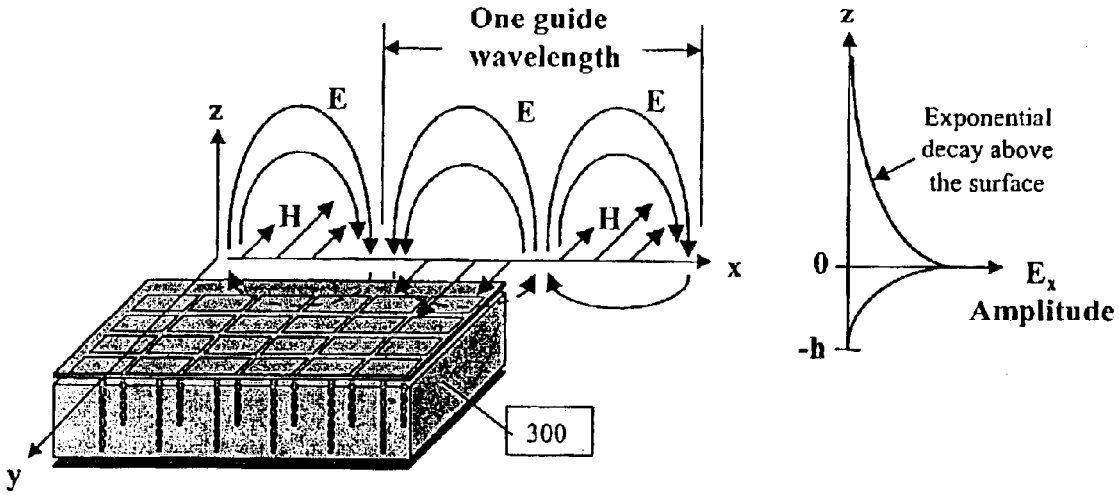
FIG. 5 illustrates electromagnetic fields of a TM mode surface wave propagating in the x direction in the artificial magnetic conductor of FIG. 3.

FIG. 4 illustrates a TE surface wave mode on the artificial magnetic conductor 300 of FIG. 3. Similarly, FIG. 5 illustrates a TM surface wave mode on the AMC 300 of FIG. 3. The coordinate axes in FIGS. 4 and 5, and as used herein, place the surface of the AMC 300 in the xy plane. The z axis is normal to the surface. The TE mode of FIG. 4 propagates in the x direction along with loops of an associated magnetic field H. The amplitude of the x component of magnetic field H both above the surface and within the surface is shown by the graph in FIG. 4. FIG. 5 shows the TM mode propagating in the x direction, along with loops of an associated electric field E. The relative amplitude of the x component of the electric field E is shown in the graph in FIG. 5.

The performance and operation of the AMC 300 will be described in terms of an effective media model. An effective media model allows transformation all of the fine, detailed, physical structure of an AMC's unit cell into that of equivalent media defined only by the permittivity and permeability parameters. These parameters allow use of analytic methods to parametrically study wave propagation on AMCs. Such analytic models lead to physical insights as to how and why AMCs work, and insights on how to improve them. They allow one to study an AMC in general terms, and then consider each physical embodiment as a specific case of this general model. However, it is to be noted that such models represent only approximations of device and material performance and are not necessarily precise calculations of that performance.

First, the effective media model for the prior art high-impedance surface is presented. Consider a prior art high-impedance surface 100 comprised of a square lattice of square patches 110 as illustrated in FIG. 6. Each patch 110 has a metal via 108 connecting it to the backplane 106. The via 108 passes through a spacer layer 102, whose isotropic host media parameters are $\epsilon_D$ and $\mu_D$.

FIG. 7 presents a new effective media model for substantially characterizing the prior art high-impedance surface of FIG. 6. Elements of the permittivity tensor are given in FIG. 7. The parameter $\alpha$ is a ratio of areas, specifically the area of the cross section of the via 108, $\pi d^2/4$, to the area of a unit cell, $a^2=A$. Each unit cell has an area A and includes one patch 110, measuring b×b in size, plus the space g in the x and y directions to an adjacent patch 110, for a pitch or period of a, and with a thickness equal to the thickness of the high impedance surface 100, or h+δ in FIG. 6. Note that $\alpha$ is typically a small number much less than unity, and usually below 1%.

In the cross sectional view of FIG. 6(*b*), the high impedance surface 100 includes a first or upper region 602 and a second or lower region 604. The lower region 604, denoted here as region 2, is referred to as a rodded media. Transverse electric and magnetic fields in this region 604 are only minimally influenced by the presence of the vias or rods 108. The effective transverse permittivity, $\epsilon_{2x}$ and permeability, $\mu_{2x}$, are calculated as minor perturbations from the media parameters of the host dielectric. This is because the electric polarisability of a circular cylinder, $\pi d^2/2$, is quite small for the thin metal rods whose diameter is small relative to the period a. Also note that effective transverse permittivity, $\epsilon_{2x}$, and permeability, $\mu_{2x}$, are constant with frequency. However, the normal, or z-directed, permittivity is highly dispersive or frequency dependent. A transverse electromagnetic (TEM) wave with a z-directed electric field traveling in a lateral direction (x or y), in an infinite rodded medium, will see the rodded media 102 as a high pass filter. The TEM wave will experience a cutoff frequency, $f_c$, below which $\epsilon_{2z}$ is negative, and above this cutoff frequency, $\epsilon_{2z}$ is positive and asymptotically approaches the host permittivity $\epsilon_D$. This cutoff frequency is essentially given by $$f_c = \frac{1}{2\pi\sqrt{\varepsilon_D\varepsilon_0\mu_D\mu_0\frac{A}{4\pi}\left[\ln\left(\frac{1}{\alpha}\right)+\alpha-1\right]}}$$

The reflection phase resonant frequency of the prior art high-impedance surface 100 is found well below the cutoff frequency of the rodded media 102, where $\epsilon_{2z}$ is quite negative.

The upper region 602, denoted as region 1, is a capacitive FSS. The transverse permittivity, $\epsilon_{1x}$ or $\epsilon_{1y}$, is increased by the presence of the edge coupled metal patches 110 so that $\epsilon_{1x}=\epsilon_{1y}>>1$, typically between 10 and 100 for a single layer frequency selective surface such as the high-impedance surface 100. The effective sheet capacitance, $C=\epsilon_o\epsilon_{1x}t$, is uniquely defined by the geometry of each patch 110, but $\epsilon_{1x}$ in the effective media model is somewhat arbitrary since t is chosen arbitrarily. The variable t is not necessarily the thickness of the patches, which is denoted as δ. However, t should be much less than the spacer layer 604 height h.

The tensor elements for the upper layer 602 of the prior art high-impedance surface 100 are constant values which do not change with frequency. That is, they are non-dispersive. Furthermore, for the upper layer 602, the z component of the permeability is inversely related to the transverse permittivity by $\mu_{1z}=2/\epsilon_{1x}$. Once the sheet capacitance is defined, $\mu_{1z}$ is fixed.

It is useful to introduce the concept of an artificial magnetic molecule. An artificial magnetic molecule (AMM) is an electrically small conductive loop which typically lies in one plane. Both the loop circumference and the loop diameter are much less than one free-space wavelength at the useful frequency of operation. The loops can be circular, square, hexagonal, or any polygonal shape, as only the loop area will affect the magnetic dipole moment. Typically, the loops are loaded with series capacitors to force them to resonate at frequencies well below their natural resonant frequency A three dimensional, regular array or lattice of AMMs is an artificial material whose permeability can exhibit a Lorentz resonance, assuming no intentional losses are added. At a Lorentz resonant frequency, the permeability of the artificial material approaches infinity. Depending on where the loop resonance is engineered, the array of molecules can behave as a bulk paramagnetic material ($\mu_r>1$) or as a diamagnetic material ($\mu_r<1$) in the direction normal to the loops. AMMs may be used to depress the normal permeability of the FSS layer, region 1, in AMCs. This in turn has a direct impact on the TE mode cutoff frequencies, and hence the surface wave bandgaps.

The prior art high impedance surface has a fundamental, or lowest, resonant frequency near $f_o=1/(2\pi\sqrt{\mu_D\mu_o hC})$, where the spacer layer is electrically thin, ($\beta h<<1$ where $\beta=\sqrt{\mu_D\mu_o\epsilon_D\epsilon_o}$). Higher order resonances are also found, but at much higher frequencies where $\beta h\approx n\pi$ and n=1, 2, 3, . . . The n=1 higher order resonance is typically 5 to 50 times higher than the fundamental resonance. Thus, a prior art high impedance surface designed to operate at low microwave frequencies (1–3 GHz) will typically exhibit its next reflection phase resonance in millimeter wave bands (above 30 GHz).

There is a need for an AMC which provides a second band or even multiple bands of high surface impedance whose resonant frequencies are all relatively closely spaced, within a ratio of about 2:1 or 3:1. This is needed, for example, for multi-band antenna applications. Furthermore, there is a need for an AMC with sufficient engineering degrees of freedom to allow the second and higher reflection phase resonances to be engineered or designated arbitrarily. Multiple reflection phase resonances are possible if more than two layers (4, 6, 8, etc.) are used in the fabrication of an AMC. However, this adds cost, weight, and thickness relative to the single resonant frequency design. Thus there is a need for a means of achieving multiple resonances from a more economical two-layer design. In addition, there is a need for a means of assuring the existence of a bandgap for bound, guided, TE and TM mode surface waves for all of the high-impedance bands, and within the +/−90° reflection phase bandwidths.

Figure 8:
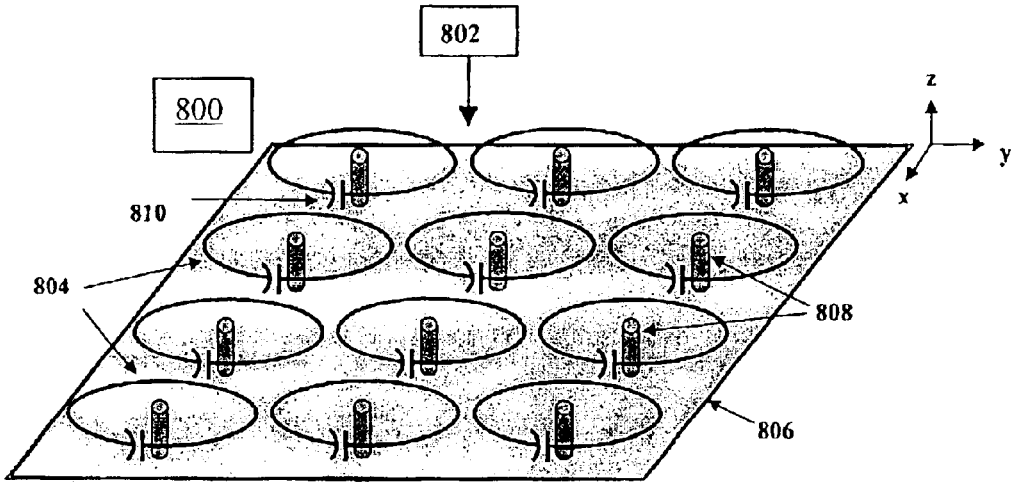
FIG. 8 illustrates a first embodiment of an artificial magnetic conductor.

FIG. 8 illustrates an artificial magnetic conductor (AMC) 800. The AMC 800 includes an array 802 that is in one embodiment a coplanar array of resonant loops or artificial magnetic molecules 804 which are strongly capacitively coupled to each other, forming a capacitive frequency selective surface (FSS). The resonant loops 804 in the illustrated embodiment are uniformly spaced and at a height h above a solid conductive ground plane 806. An array of electrically short, conductive posts or vias 808 are attached to the ground plane 806 only and have a length h. Each loop 804 includes a lumped capacitive load 810. The one or more layers of artificial magnetic molecules (AMMs) or resonant loops of the artificial magnetic conductor 800 create a frequency dependent permeability in the z direction, normal to the surface of the AMC 800.

An AMC 800 with a single layer of artificial magnetic molecules 804 is shown in FIG. 8. In this embodiment, each loop and capacitor load are substantially identical so that all loops have substantially the same resonant frequency. In alternative embodiments, loops having different characteristics may be used. In physical realizations, due to manufacturing tolerances and other causes, individual loops and their associated resonant frequencies will not necessarily be identical.

Figure 9:
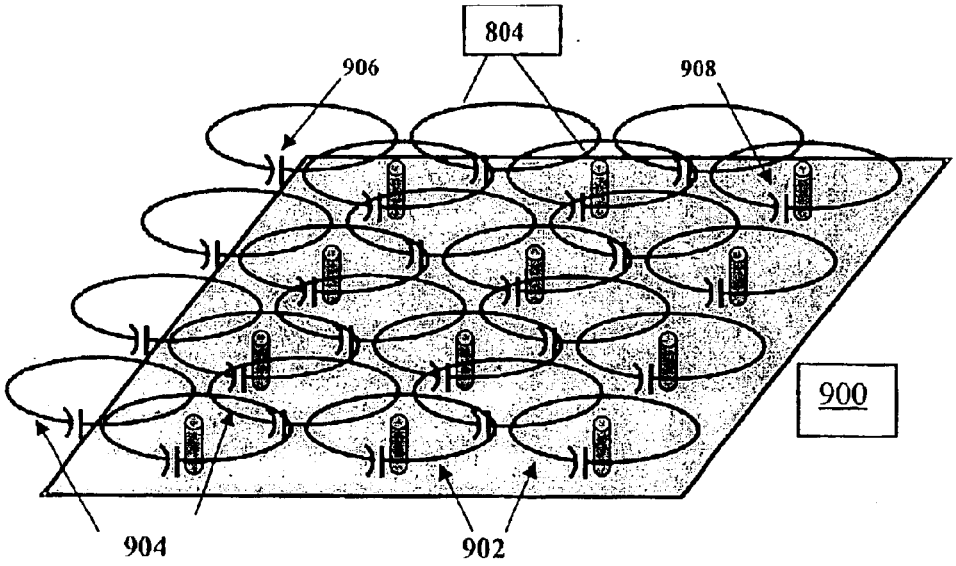
FIG. 9 illustrates a second, multiple layer embodiment of an artificial magnetic conductor.
Figure 10:
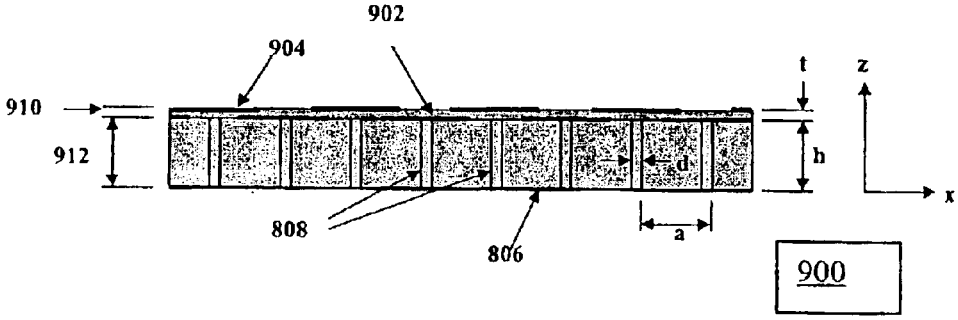
FIG. 10 is a cross sectional view of the artificial magnetic conductor of FIG. 9.

An AMC 900 with multiple layers of artificial magnetic molecules 804 is shown in FIG. 9. FIG. 10 is a cross sectional view of the artificial magnetic conductor 900 of FIG. 9. The AMC 900 includes a first layer 902 of loops 804 resonant at a first frequency $f_1$. The AMC 900 includes a second layer 904 of loops 804 resonant at a second frequency $f_2$. Each loop 804 of the first layer 902 of loops includes a lumped capacitive load $C_1$ 908. Each loop 804 of the second layer 904 of loops includes a lumped capacitive load $C_2$ 906. The lumped capacitances may be the same but need not be. In combination, the first layer 902 of loops 804 and the second layer 906 of loops 904 form a frequency selective surface (FSS) layer 910 disposed on a spacer layer 912. In practical application, the low frequency limit of the transverse effective relative permittivity, $\epsilon_{1x}$ and $\epsilon_{1y}$, for the multiple layer AMC 900 lies between 100 and 2000. Accordingly, strong capacitive coupling is present between loops 902 and 904. A practical way to achieve this coupling is to print two layers of loops on opposite sides of an FSS dielectric layer as shown in FIG. 10. Other realizations may be chosen as well.

Figure 11:
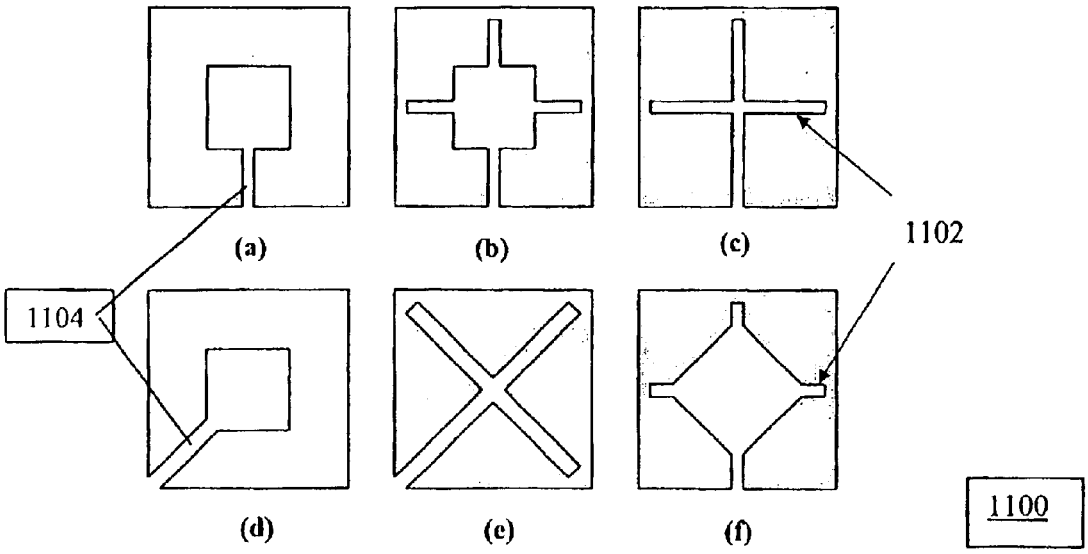
FIG. 11 illustrates a first physical embodiment of a loop for an artificial magnetic molecule.

FIG. 11 illustrates a first physical embodiment of a loop 1100 for use in an artificial magnetic conductor such as the AMC 800 of FIG. 8. Conducting loops such as loop 1100 which form the artificial magnetic molecules can be implemented in a variety of shapes such as square, rectangular, circular, triangular, hexagonal, etc. In the embodiment of FIG. 11, the loop 1100 is square in shape. Notches 1102 can be designed in the loops to increase the self inductance, which lowers the resonant frequency of the AMMs. Notches 1102 and gaps 1104 can also be introduced to engineer the performance of the loop 1100 to a particular desired response. For example, the bands or resonance frequencies may be chosen by selecting a particular shape for the loop 1100. In general, a gap 1104 cuts all the way through a side of the loop 1100 from the center of the loop 1100 to the periphery. In contrast, a notch cuts through only a portion of a side between the center and periphery of the loop 1100. FIG. 11 illustrates a selection of potential square loop designs.

Figure 12:
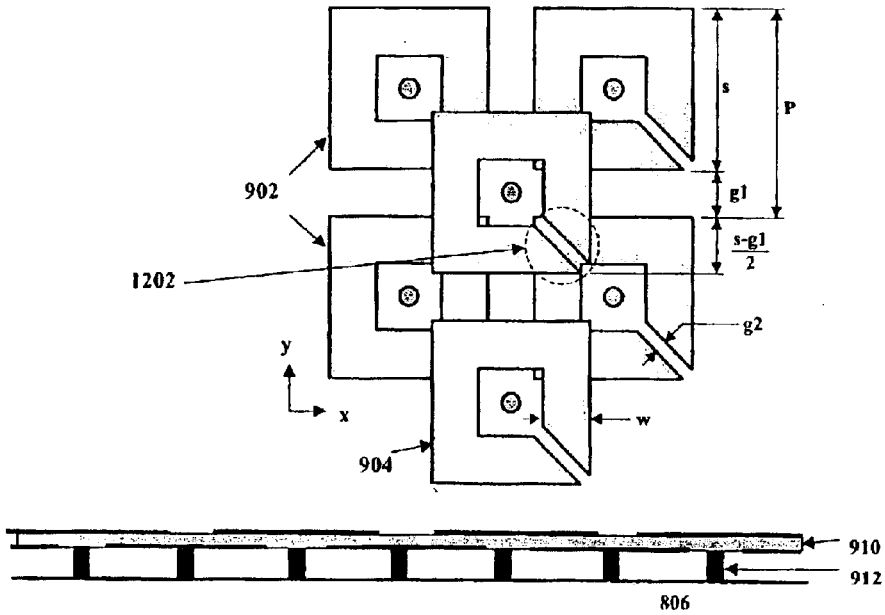
FIG. 12 illustrates a multiple layer artificial magnetic conductor using the loop of FIG. 11(*d*)

FIG. 12 illustrates a portion of a two layer artificial magnetic conductor whose FSS layer uses a square loop of FIG. 11(*d*). Wide loops with relatively large surface area promote capacitive coupling between loops of adjacent layers when used in a two-layer overlapping AMC, as illustrated in FIG. 12. An overlap region 1202 at the gap 1104 provides the series capacitive coupling required for loop resonance.

Figure 13:
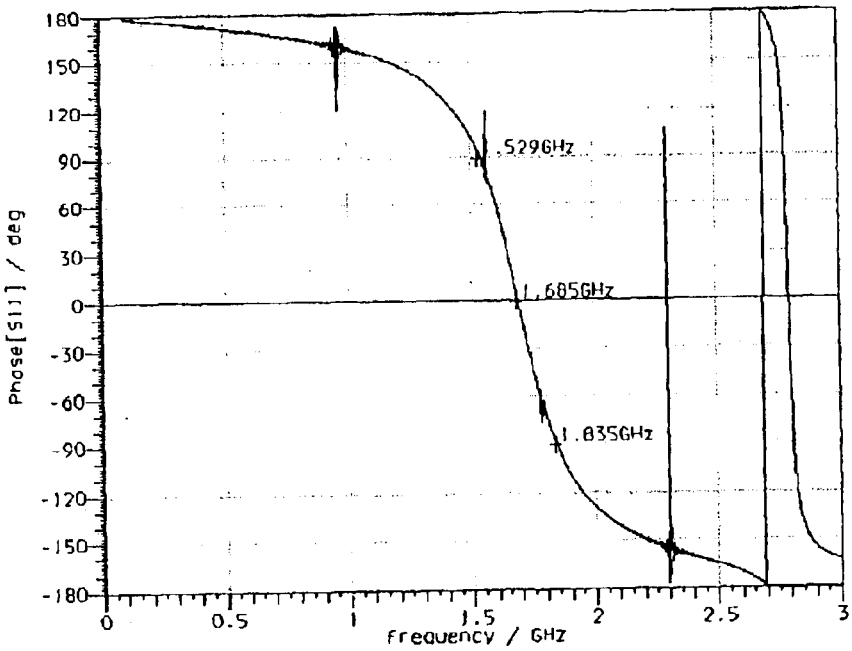
FIG. 13 shows y-polarized electromagnetic simulation results for the normal-incidence reflection phase of the artificial magnetic conductor illustrated in FIG. 12.
Figure 14:
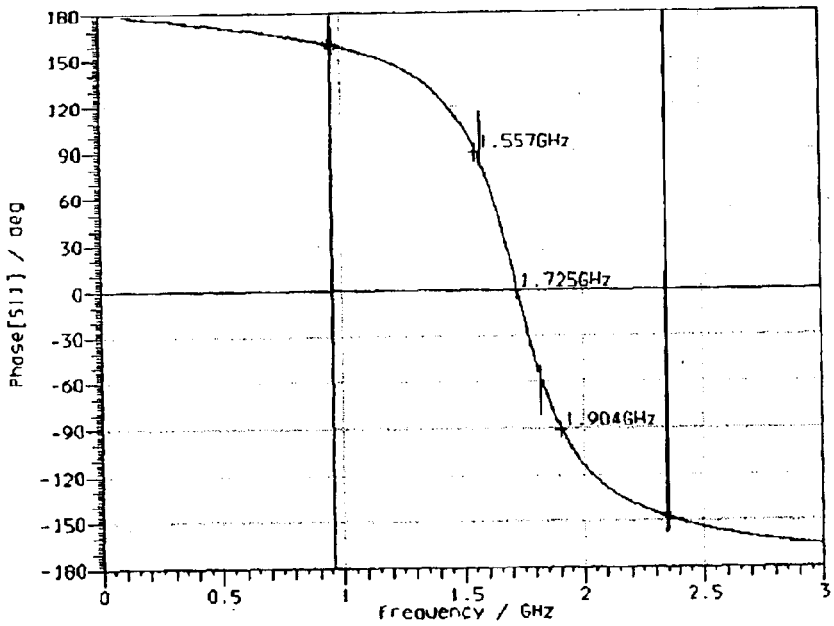
FIG. 14 shows y-polarized electromagnetic simulation results for the normal-incidence reflection phase of the artificial magnetic conductor very similar to that illustrated in FIG. 12, except the gaps in the loops are now shorted together.

FIG. 13 and FIG. 14 show simulation results for the normal-incidence reflection phase of the AMC illustrated in FIG. 12. In both simulations, the incident electric field is y-polarized. In the simulation illustrated in FIG. 13, P=10.4 mm, h=6 mm, t=0.2 mm, s=7.2 mm, w=1.6 mm, g2=0.4 mm, $\epsilon_{r1}=\epsilon_{r2}=3.38$. FIG. 13 shows a fundamental resonance near 1.685 GHz, and a second resonance near 2.8 GHz. In FIG. 14, when the gap in the loops is eliminated so that the loops are shorted and g2=0 in FIG. 12, then only one resonance is obtained. The reason that the AMC 800 with gaps 1104 has a second resonance is that the effective transverse permittivity of the frequency selective surface has become frequency dependent. A simple capacitive model is no longer adequate.

Figure 15:
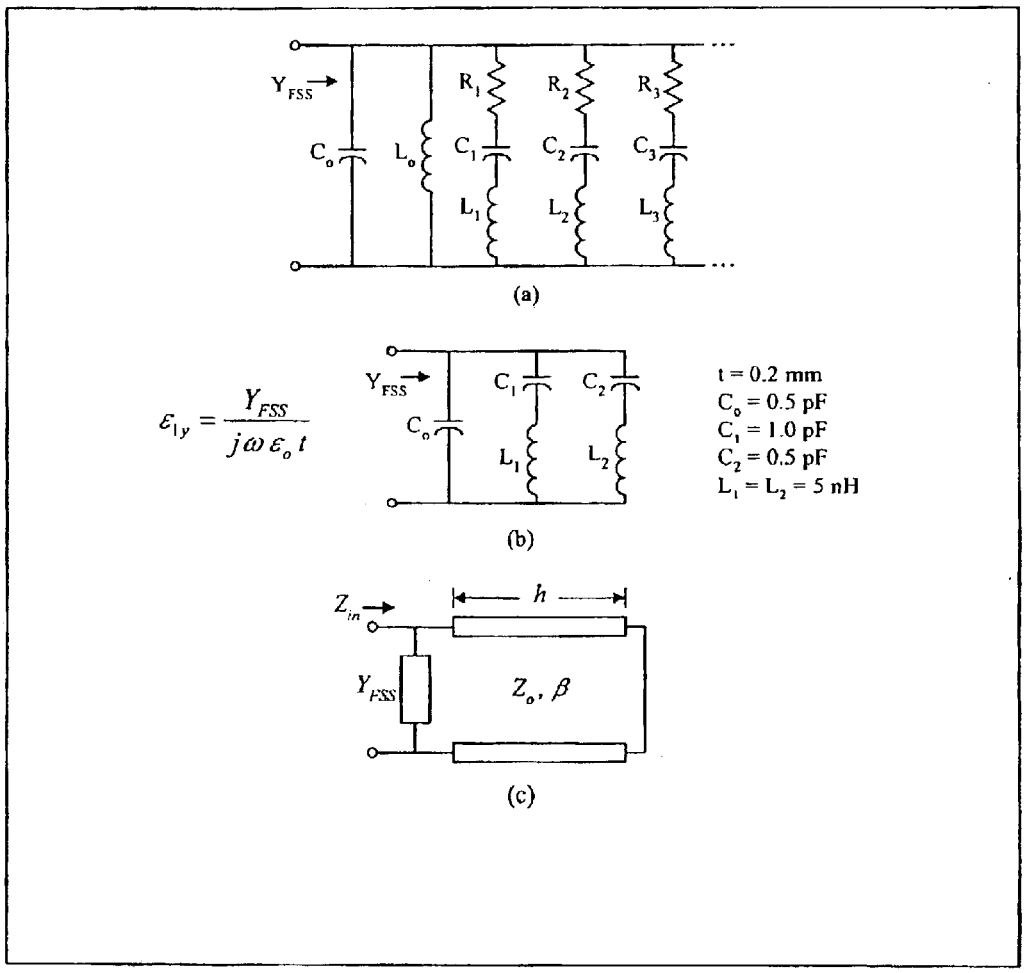
FIG. 15 shows the TEM mode equivalent circuits for the top layer, or FSS layer, of a two layer artificial magnetic conductor of FIG. 8.

FIG. 15 shows equivalent circuits for portions of the artificial magnetic conductor 800 of FIG. 8. FIG. 15(*a*) illustrates the second Foster canonical form for the input admittance of a one-port circuit, which is a general analytic model for the effective transverse permittivity of complex frequency selective surface (FSS) structures. FIG. 15(*b*) gives an example of a specific equivalent circuit model for an FSS whereby two material or intrinsic resonances are assumed. FIG. 15(*c*) shows the TEM mode equivalent circuit for plane waves normally incident on a two layer AMC, such as AMC 900 of FIG. 9. As noted above, the models developed herein are useful for characterizing, understanding, designing and engineering devices such as the AMCs described and illustrated herein. These models represent approximations of actual device behavior.

Complex loop FSS structures, such as that shown in FIG. 12, have a dispersive, or frequency dependent, effective transverse permittivity which can be properly modeled using a more complex circuit model. Furthermore, analytic circuit models for dispersive dielectric media can be extended in applicability to model the transverse permittivity of complex FSS structures. The second Foster canonical circuit for one-port networks, shown in FIG. 15(*a*), is a general case which should cover all electrically-thin FSS structures. Each branch manifests an intrinsic resonance of the FSS. For an FSS made from low loss materials, $R_n$ is expected to be very low, hence resonances are expected to be Lorentzian.

Figure 16:
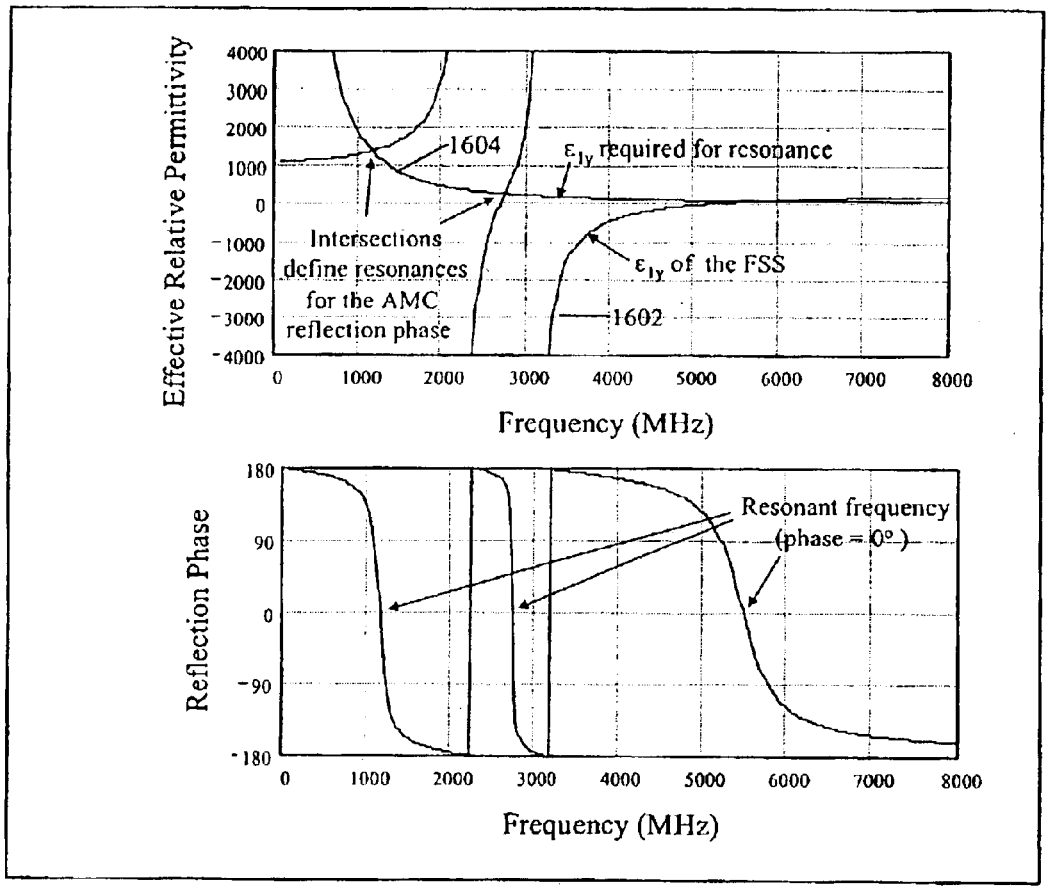
FIG. 16 illustrates the effective relative permittivity for a specific case of a multi-resonant FSS, and the corresponding reflection phase; for an AMC which uses this FSS as its upper layer.

The effective sheet capacitance for the loop FSS shown in FIG. 12 has a Lorentz resonance somewhere between 1.685 GHz and 2.8 GHz. In fact, if the transverse permittivity of this FSS is modeled using only a three-branch admittance circuit, as shown in FIG. 15(*b*), the $\epsilon_{1y}$ curve 1602 shown in the upper graph of FIG. 16 is obtained. Two FSS material resonances are evident near 2.25 GHz and 3.2 GHz. The $\epsilon_{1y}$ curve 1604 is the transverse relative permittivity required to achieve resonance for the AMC, a zero degree reflection phase. This curve 1604 is simply found by equating the capacitive reactance of the FSS, $X_c=1/(\omega C)=1/(\omega\epsilon_{1y}\epsilon_o t)$, to the inductive reactance of the spacer layer, $X_L=\omega L=\omega\mu_{2x}\mu_o h$, and solving for transverse relative permittivity: $\epsilon_{1y}=1/(\omega^2\mu_{2x}\mu_o\epsilon_o ht)$. Intersections of the curve 1602 and the curve 1604 define the frequencies for reflection phase resonance. The reflection phase curve shown in the lower graph of FIG. 16 was computed using the transmission line model shown in FIG. 15(*c*) in which the admittance of the FSS is placed in parallel with the shorted transmission line of length h representing the spacer layer and backplane. This circuit model predicts a dual resonance near 1.2 GHz and 2.75 GHz, which are substantially the frequencies of intersection in the $\epsilon_{1y}$ plot. Thus the multiple resonant branches in the analytic circuit model for the FSS transverse permittivity can be used to explain the existence of multiple AMC phase resonances. Any realizable FSS structure can be modeled accurately using a sufficient number of shunt branches.

Figure 17:
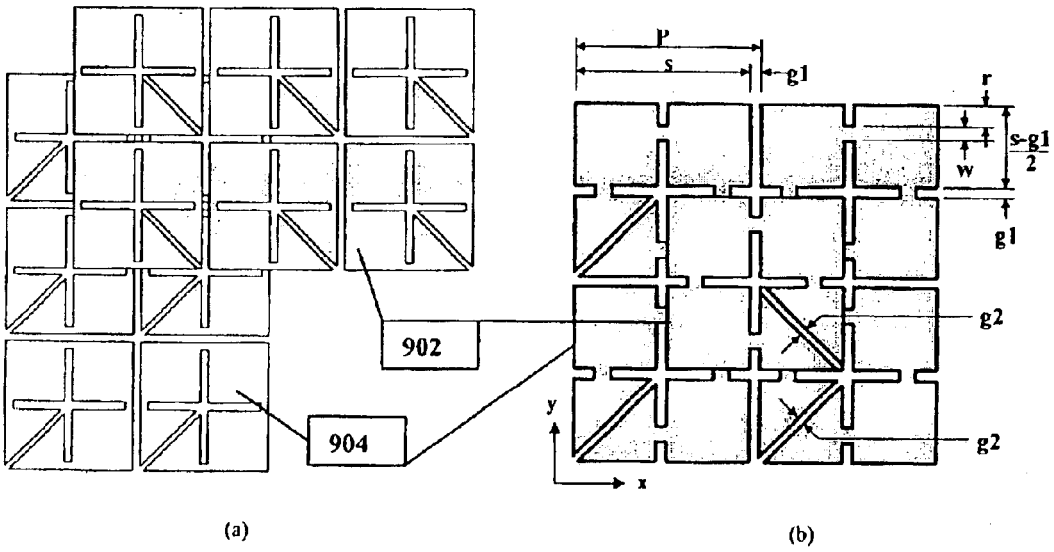
FIG. 17 shows an alternative embodiment for a frequency selective surface implemented with square loops.
Figure 18:
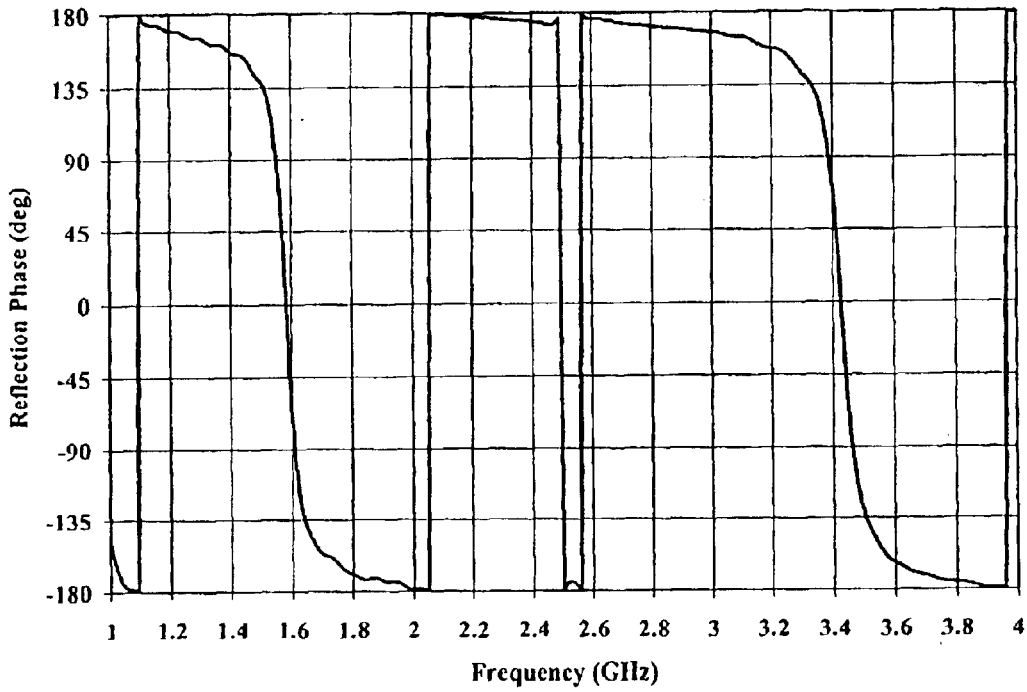
FIG. 18 shows measured reflection phase data for an x polarized electric field normally incident on the AMC of FIG. 17.
Figure 19:
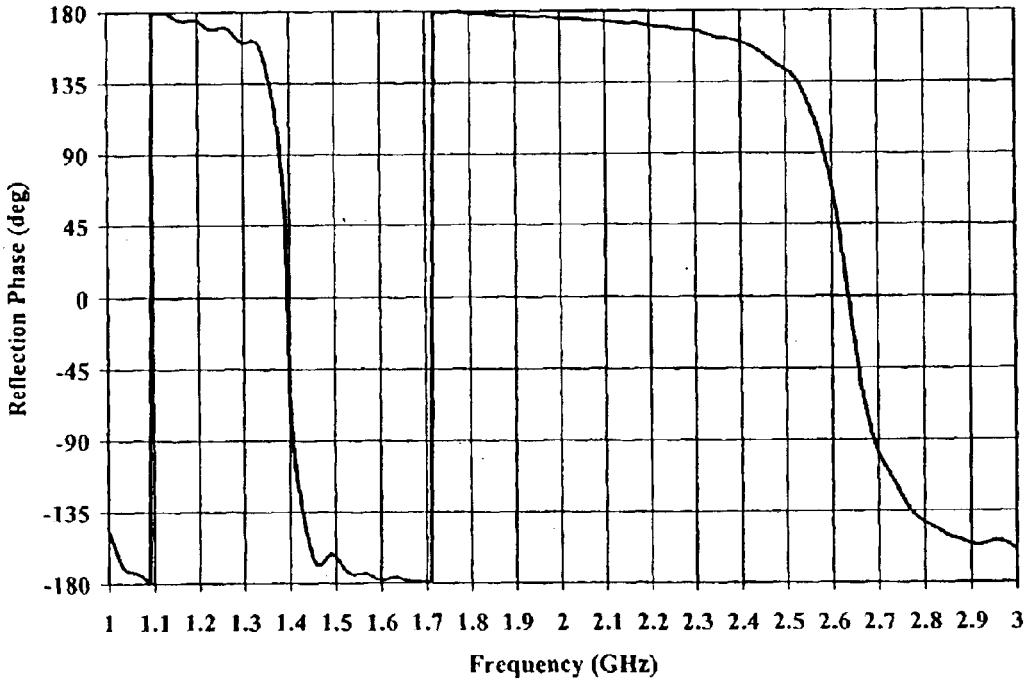
FIG. 19 shows measured reflection phase data for a y polarized electrical field normally incident on the AMC of FIG. 17.
Figure 20:
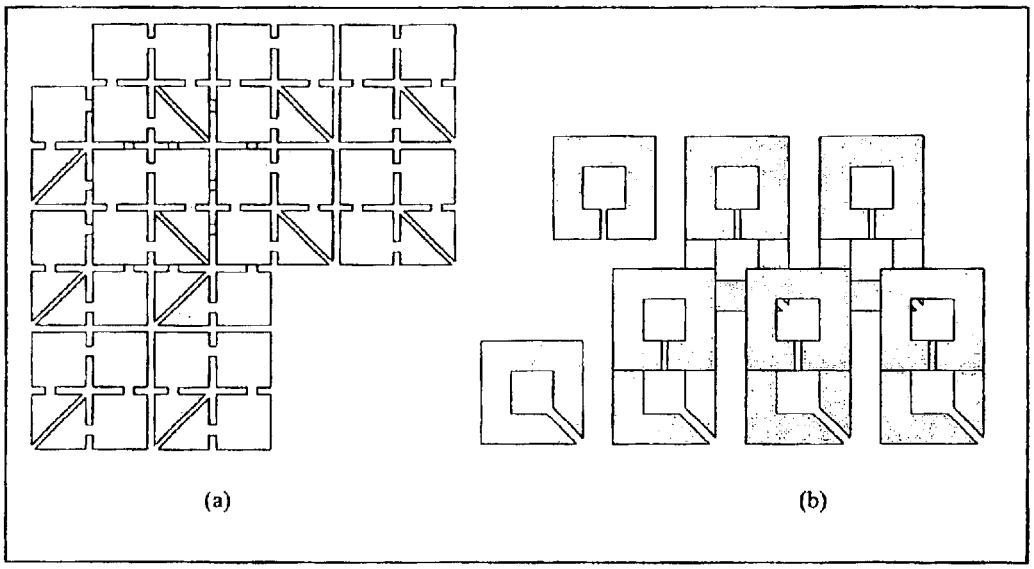
FIG. 20 shows additional alternative embodiments for a frequency selective surface implemented with square loops.
Figure 21:
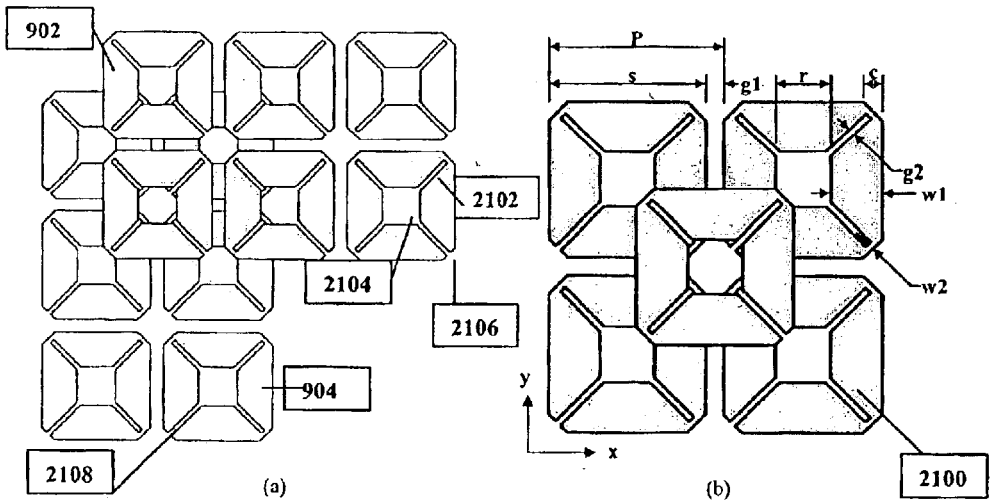
FIG. 21 shows additional alternative embodiments for a frequency selective surface implemented with square loops.

There are many additional square loop designs which may be implemented in FSS structures to yield a large transverse effective permittivity. More examples are shown in FIGS. 17, 20 and 21 where loops of substantially identical size and similar shape are printed on opposite sides of a single dielectric layer FSS. Reflection phase results for x and y polarized electric fields applied to an AMC of the design shown in FIG. 17 are shown in FIGS. 18 and 19. In this design, P=400 mils, g1=30 mils, g2=20 mils, r=40 mils, w=30 mils, t=8 mils, and h=60 mils. $\epsilon_r$=3.38 in both FSS and spacer layers since this printed AMC is fabricated using Rogers R04003 substrate material. In the center of each loop, a via is fabricated using a 20 mil diameter plated through hole.

FIG. 18 shows measured reflection phase data for an x polarized electric field normally incident on the AMC of FIG. 17. Resonant frequencies are observed near 1.6 GHz and 3.45 GHz. Similarly, FIG. 19 shows measured reflection phase data for a y polarized electric field normally incident on the AMC of FIG. 17. Resonant frequencies are observed near 1.4 GHz and 2.65 GHz.

In FIGS. 18 and 19, a dual resonant performance is clearly seen in the phase data. For the specific case fabricated, each polarization sees different resonant frequencies. However, it is believed that the design has sufficient degrees of freedom to make the resonance frequencies polarization independent.

Figure 22:
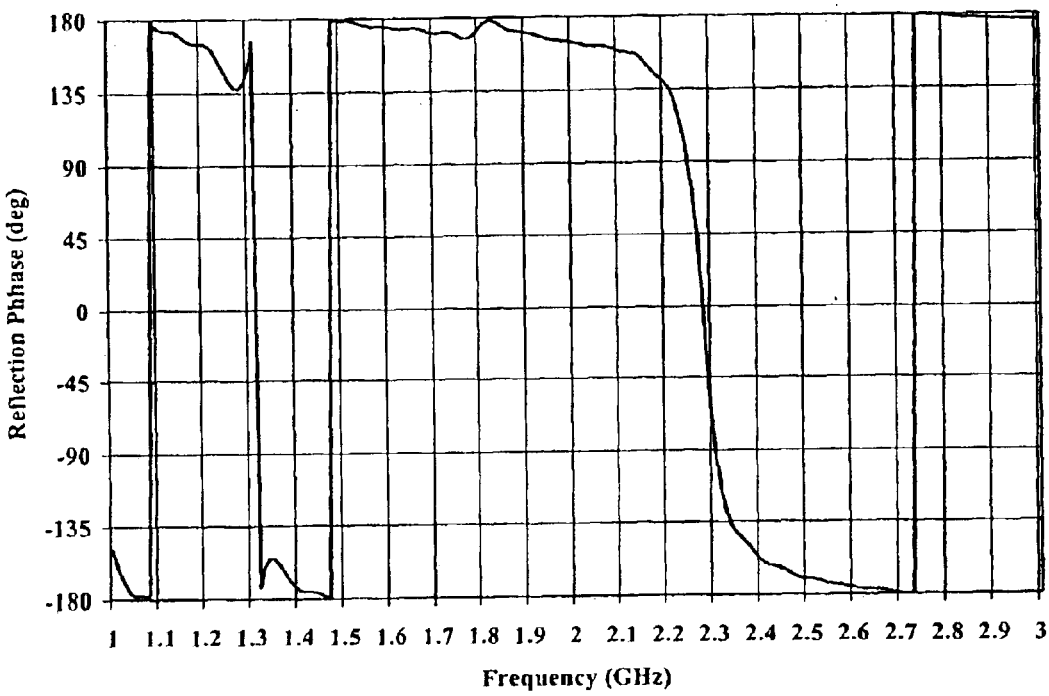
FIG. 22 shows measured reflection phase data for an x polarized electric field normally incident on the AMC of FIG. 21.
Figure 23:
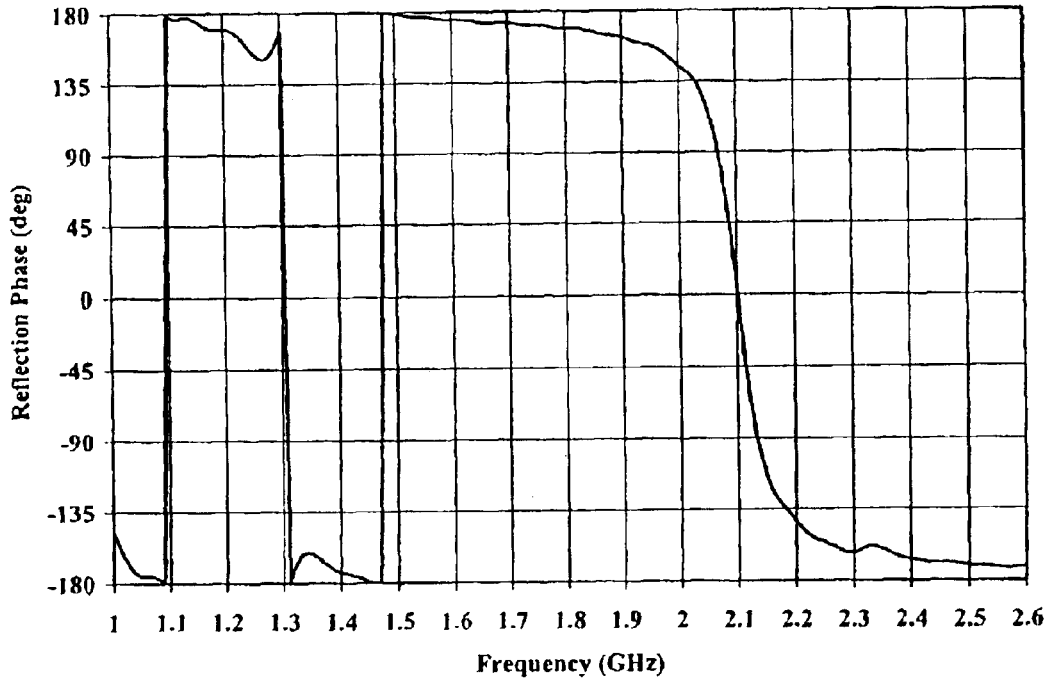
FIG. 23 shows measured reflection phase data for a y polarized electrical field normally incident on the AMC of FIG. 21.

FIG. 21 shows an additional alternative embodiment for a frequency selective surface implemented with square loops. The illustrated loop design of FIG. 21 has overlapping square loops 2100 on each layer 902, 904 with deep notches 2102 cut from the center 2104 toward each corner. Gaps 2106, 2108 are found at the 4:30 position on the upper layer and at the 7:30 position on the lower layer respectively. This design was also fabricated, using h=60 mils and t=8 mils of Rogers R04003 ($\epsilon_r$=3.38) as the spacer layer and FSS layer thickness respectively. AMC reflection phase for the x and y directed E field polarization is shown in FIGS. 22 and 23 respectively. Again, dual resonant frequencies are clearly seen.

Figure 24:
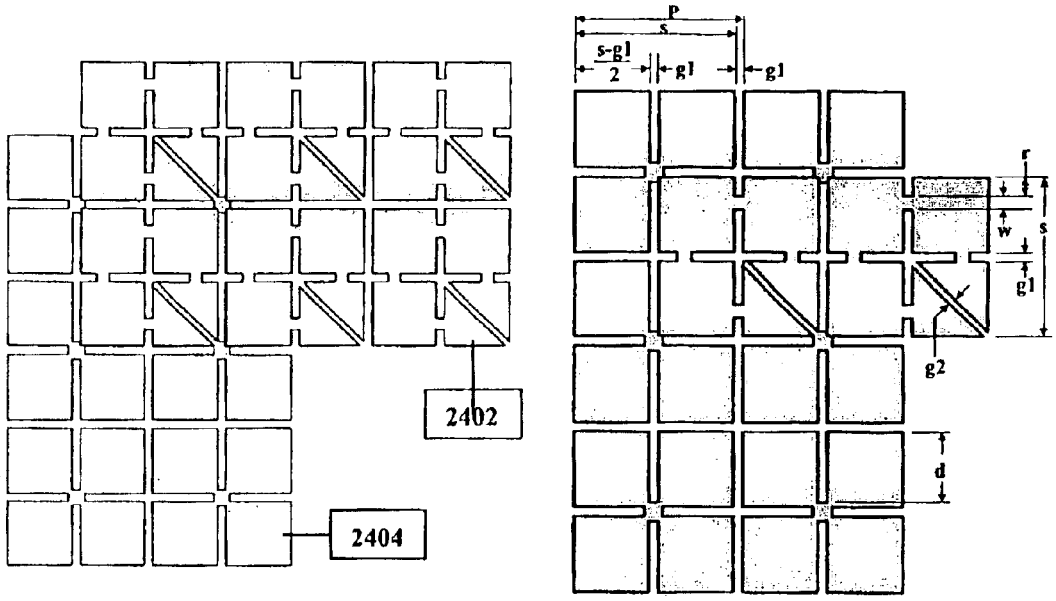
FIG. 24 illustrates another embodiment of a capacitive frequency selective surface structure consisting of a layer of loops closely spaced to a layer of patches.

An alternative type of dispersive capacitive FSS structure can be created where loops 2402 are printed on the one side and notched patches 2404 are printed on the other side of a single dielectric layer FSS. An example is shown in FIG. 24.

In addition to the square loops illustrated in FIGS. 17, 20, 21 and 24, hexagonal loops can be printed in a variety of shapes that include notches which increase the loop self inductance. These notches may vary in number and position, and they are not necessarily the same size in a given loop. Furthermore, loops printed on opposite sides of a dielectric layer can have different sizes and features. There are a tremendous number of independent variables which uniquely define a multilayer loop FSS structure.

Figure 25:
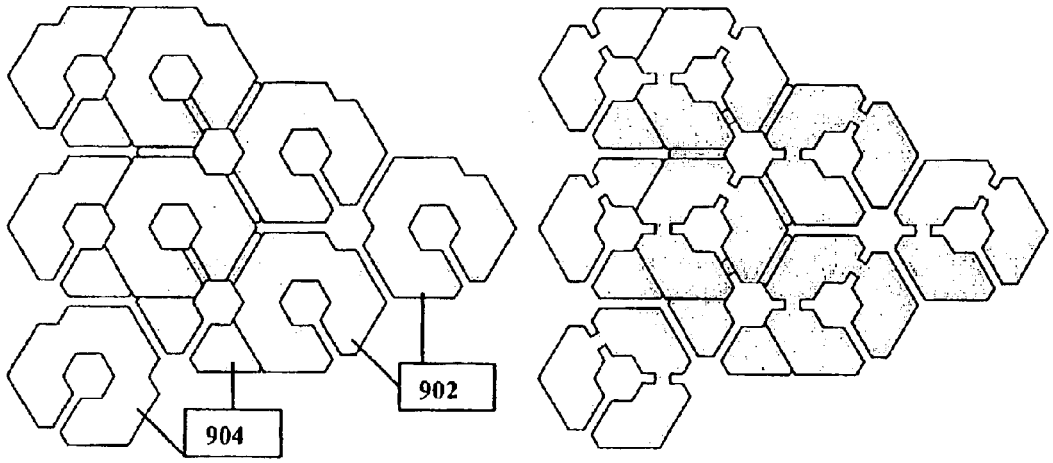
FIG. 25 illustrates an alternative embodiment of a capacitive frequency selective surface structure using hexagonal loops.
Figure 26:
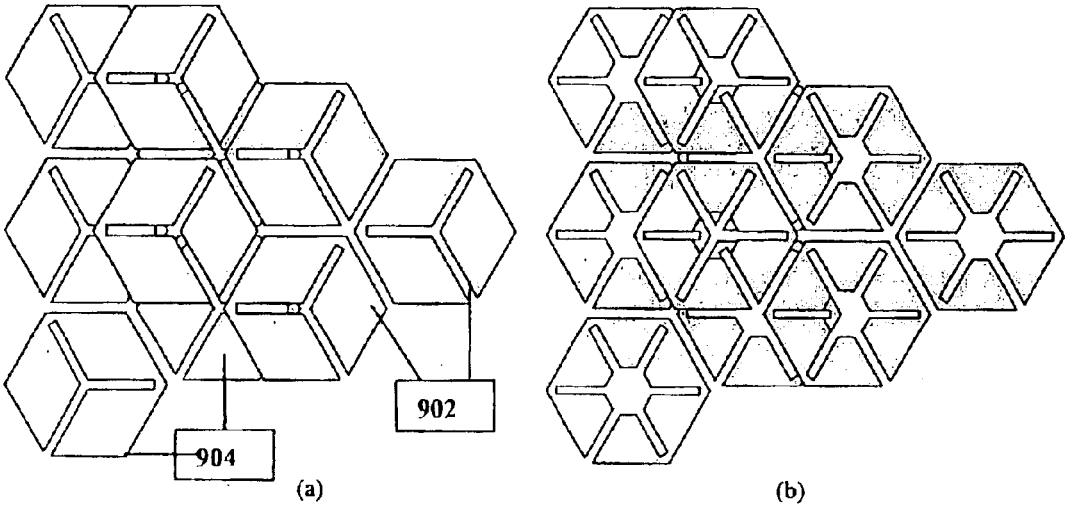
FIG. 26 illustrates an alternative embodiment of a capacitive frequency selective surface structure using hexagonal loops.
Figure 27:
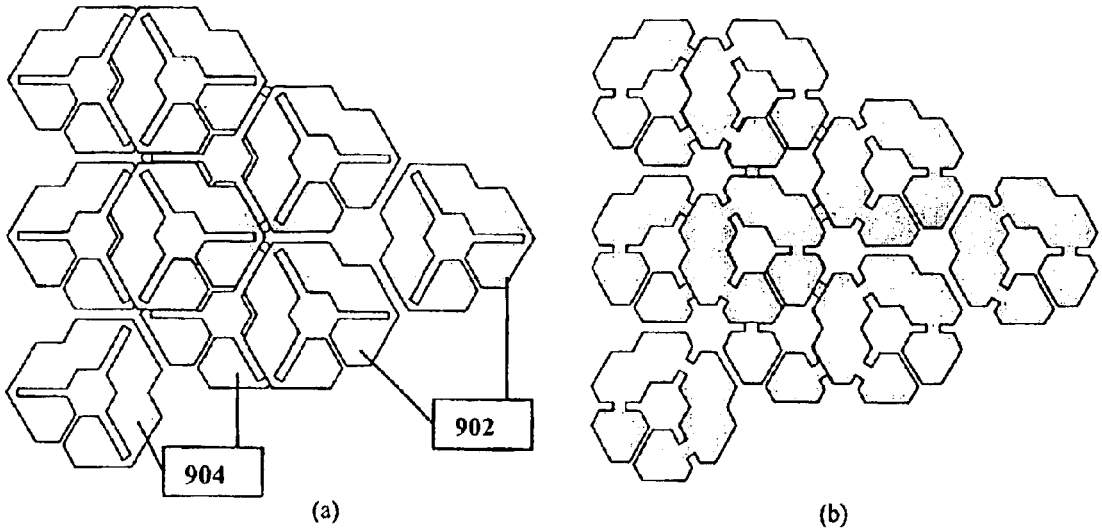
FIG. 27 illustrates an alternative embodiment of a capacitive frequency selective surface structure using hexagonal loops.

Six possibilities of hexagonal loop FSS designs are illustrated in FIGS. 25, 26 and 27. In each of FIGS. 25, 26 and 27, a first layer 902 of loops is capacitively coupled with a second layer of loops 904. The hexagonal loops presented here are intended to be regular hexagons. Distorted hexagons could be imagined in this application, but their advantage is unknown at this time.

Figure 28:
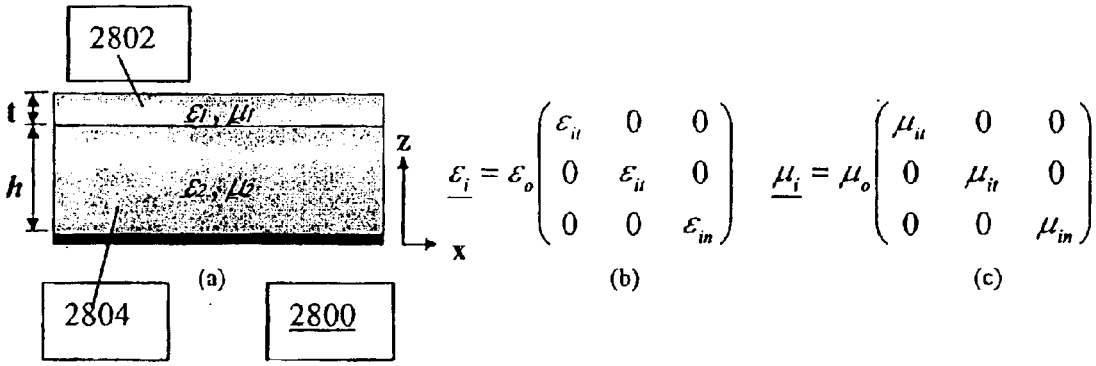
FIG. 28 illustrates an effective media model for an artificial magnetic conductor.

FIG. 28 illustrates an effective media model for a high impedance surface 2800. The general effective media model of FIG. 28 is applicable to high impedance surfaces such as the prior art high impedance surface 100 of FIG. 1 and the artificial magnetic conductor (AMC) 800 of FIG. 8. The AMC 800 includes two distinct electrically-thin layers, a frequency selective surface (FSS) 802 and a spacer layer 804. Each layer 802, 804 is a periodic structure with a unit cell repeated periodically in both the x and y directions. The periods of each layer 802, 804 are not necessarily equal or even related by an integer ratio, although they may be in some embodiments. The period of each layer is much smaller than a free space wavelength $\lambda$ at the frequency of analysis ($\lambda$/10 or smaller). Under these circumstances, effective media models may be substituted for the detailed fine structure within each unit cell. As noted, the effective media model does not necessarily characterize precisely the performance or attributes of a surface such as the AMC 800 of FIG. 8 but merely models the performance for engineering and analysis. Changes may be made to aspects of the effective media model without altering the overall effectiveness of the model or the benefits obtained therefrom.

As will be described, the high impedance surface 2800 for the AMC 800 of FIG. 8 is characterized by an effective media model which includes an upper layer and a lower layer, each layer having a unique tensor permittivity and tensor permeability. Each layer's tensor permittivity and each layer's tensor permeability have non-zero elements on the main tensor diagonal only, with the x and y tensor directions being in-plane with each respective layer and the z tensor direction being normal to each layer. The result for the AMC 800 is an AMC resonant at multiple resonance frequencies.

In the two-layer effective media model of FIG. 28, each layer 2802, 2804 is a bi-anisotropic media, meaning both permeability $\mu$ and permittivity $\epsilon$ are tensors. Further, each layer 2802, 2804 is uniaxial meaning two of the three main diagonal components are equal, and off-diagonal elements are zero, in both $\mu$ and $\epsilon$. So each layer 2802, 2804 may be considered a bi-uniaxial media. The subscripts t and n denote the transverse (x and y directions) and normal (z direction) components.

Each of the two layers 2802, 2804 in the bi-uniaxial effective media model for the high impedance surface 2800 has four material parameters: the transverse and normal permittivity, and the transverse and normal permeability. Given two layers 2802, 2804, there are a total of eight material parameters required to uniquely define this model. However, any given type of electromagnetic wave will see only a limited subset of these eight parameters. For instance, uniform plane waves at normal incidence, which are a transverse electromagnetic (TEM) mode, are affected by only the transverse components of permittivity and permeability. This means that the normal incidence reflection phase plots, which reveal AMC resonance and high-impedance bandwidth, are a function of only $\mu_{1t}$, $\epsilon_{2t}$, $\mu_{1t}$ and $\mu_{2t}$ (and heights h and t). This is summarized in Table 1 below.

TABLE 1

| Wave Type | Electric Field Sees | Magnetic Field Sees |
|---|---|---|
| TEM, normal incidence | $\epsilon_{1t}$, $\epsilon_{2t}$ | $\mu_{1t}$, $\mu_{2t}$ |
| TE to x | $\epsilon_{1t}$, $\epsilon_{2t}$ | $\mu_{1t}$, $\mu_{2t}$, $\mu_{1n}$, $\mu_{2n}$ |
| TM to x | $\epsilon_{1t}$, $\epsilon_{2t}$, $\epsilon_{1n}$, $\epsilon_{2n}$ | $\mu_{1t}$, $\mu_{2t}$ |

A transverse electric (TE) surface wave propagating on the high impedance surface 2800 has a field structure shown in FIG. 4. By definition, the electric field (E field) is transverse to the direction of wave propagation, the +x direction. It is also parallel to the surface. So the electric field sees only transverse permittivities. However, the magnetic field (H field) lines form loops in the xz plane which encircle the E field lines. So the H field sees both transverse and normal permeabilities.

The transverse magnetic (TM) surface wave has a field structure shown in FIG. 5. Note that, for TM waves, the role of the E and H fields is reversed relative to the TE surface waves. For TM modes, the H field is transverse to the direction of propagation, and the E field lines (in the xz plane) encircle the H field. So the TM mode electric field sees both transverse and normal permittivities.

The following conclusions may be drawn from the general effective media model of FIG. 28. First, $\epsilon_{1n}$ and $\epsilon_{2n}$ are fundamental parameters which permit independent control of the TM modes, and hence the dominant TM mode cutoff frequency. Second, $\mu_{1n}$ and $\mu_{2n}$ are fundamental parameters which permit independent control of the TE modes, and hence the dominant TE mode cutoff frequency.

Figure 1:
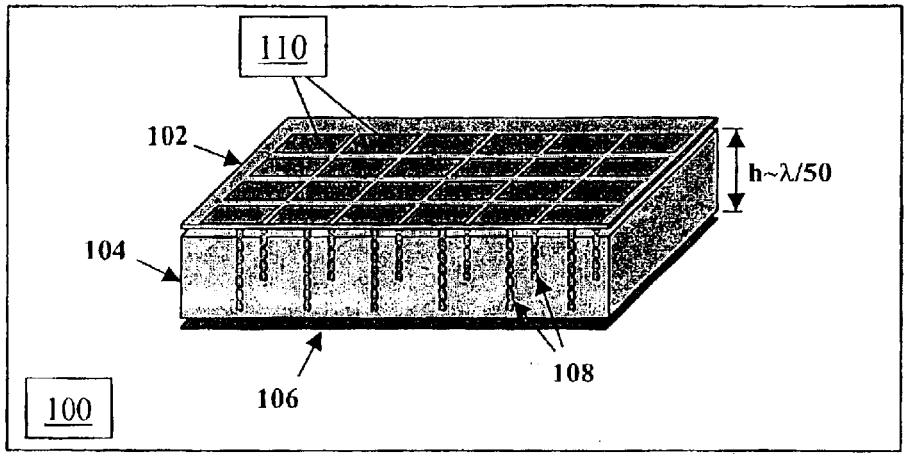
FIG. 1 (Prior Art)
FIG. 1 is a perspective view of a prior art high impedance surface.
Figure 2:
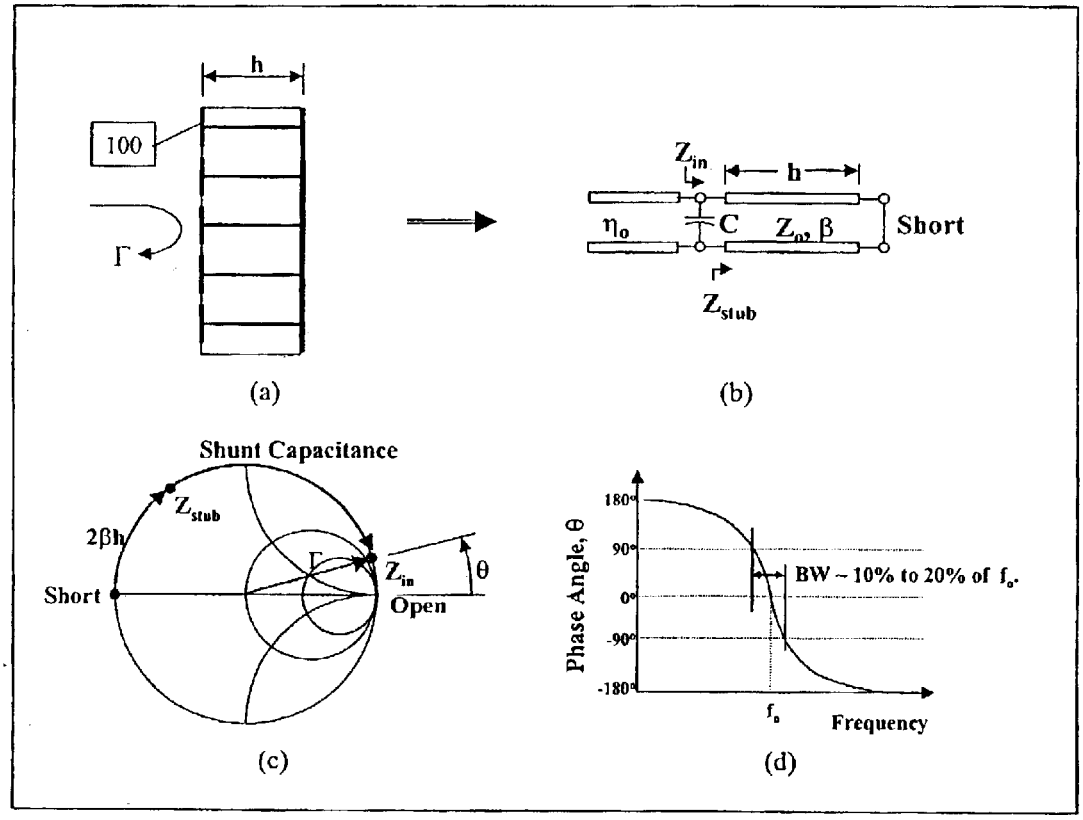
FIG. 2 (Prior Art)
FIG. 2 illustrates a reflection phase model for the prior art high impedance surface.
Figure 29:
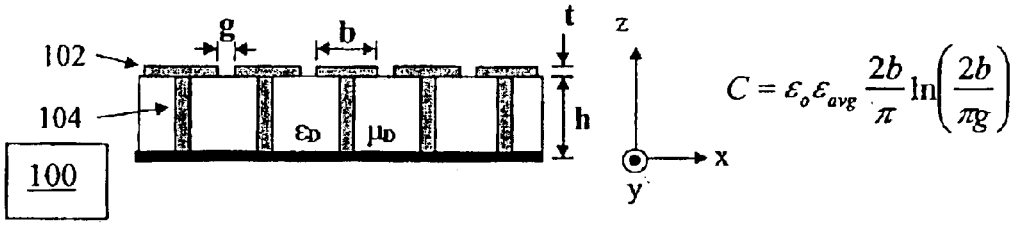
FIG. 29 (Prior Art)
FIG. 29 illustrates a prior art high impedance surface.

One way to distinguish between prior art high impedance surface 100 of FIG. 1 and an AMC such as AMC 800 (FIG. 8) or AMC 900 (FIG. 9, FIG. 10) is by examining the differences in the elements of the $\underline{\mu}_i$ and $\underline{\mu}_i$ tensors. FIG. 29 shows a prior art high impedance surface 100 whose frequency selective surface 102 is a coplanar layer of square conductive patches of size b×b, separated by a gap of dimension g. In the high impedance surface 100, $\epsilon_D$ is the relative permittivity of the background or host dielectric media in the spacer layer 104, $\mu_D$ is the relative permeability of this background media in the spacer layer 104, and $\alpha$ is the ratio of cross sectional area of each rod or post to the area A of the unit cell in the rodded media or spacer layer 104. The relative permittivity $$\varepsilon_{avg} = \frac{1+\varepsilon_D}{2}$$

is the average of the relative dielectric constants of air and the background media in the spacer layer 104. C denotes the fixed FSS sheet capacitance.

The permittivity tensor for both the high-impedance surface 100 and the AMCs 800, 900 is uniaxial, or $\epsilon_{ix}=\epsilon_{iy}=\epsilon_{it}\neq\epsilon_{iz}\epsilon_{in}$; i=1, 2 with the same being true for the permeability tensor. The high impedance surface 100 has a square lattice of both rods and square patches, each having the same period. Therefore, unit cell area $A=(g+b)^2$. Also, $\alpha=(\pi d^2/4)/A$, where d is the diameter of the rods or posts. The dimensions of the rods or posts are very small relative to the wavelength at the resonance frequencies. The rods or posts may be realized by any suitable physical embodiment, such as plated-through holes or vias in a conventional printed circuit board or by wires inserted through a foam. Any technique for creating a forest of vertical conductors (i.e., parallel to the z axis), each conductor being electrically coupled with the ground plane, may be used. The conductors or rods may be circular in cross section or may be flat strips of any cross section whose dimensions are small with respect to the wavelength $\lambda$ in the host medium or dielectric of the spacer layer. In this context, small dimensions for the rods are generally in the range of $\lambda/1000$ to $\lambda/25$.

In some embodiments, the AMC 800 has transverse permittivity in the y tensor direction substantially equal to the transverse permittivity in the x tensor direction. This yields an isotropic high impedance surface in which the impedance along the y axis is substantially equal to the impedance along the x axis. In alternative embodiments, the transverse permittivity in the y tensor direction does not equal the transverse permittivity in the x tensor direction to produce an anisotropic high impedance surface, meaning the impedances along the two in-plane axes are not equal. Examples of the latter are shown in FIGS. 17 and 21.

Effective media models for substantially modelling both the high impedance surface 100 and an AMC 800, 900 are listed in Table 2. Two of the tensor elements are distinctly different in the AMC 800, 900 relative to the prior art high-impedance surface 100. These are the transverse permittivity $\epsilon_{1x}$,$\epsilon_{1y}$ and the normal permeability $\mu_{1z}$, both of the upper layer or frequency selective surface. The model for the lower layer or spacer layer is the same in both the high impedance surface 100 and the AMC 800, 900.

TABLE 2

| | High impedance surface 100 | AMC 800, 900 |
|---|---|---|
| FSS Layer (upper layer) | $\varepsilon_{1x} = \varepsilon_{1y} = \frac{C}{\varepsilon_o t}$ | $\varepsilon_{1x} = \varepsilon_{1y} = \frac{Y(\omega)}{j\omega\varepsilon_o t}$ |
| | $\epsilon_{1z} = 1$ | $\epsilon_{1z} = 1$ |
| | $\mu_{1x} = \mu_{1y} = 1$ | $\mu_{1x} = \mu_{1y} = 1$ |
| | $\mu_{1z} = \frac{2\varepsilon_{avg}}{\varepsilon_{1x}}$ | $\mu_{1z} = \frac{Z(\omega)}{j\omega\mu_o t}$ |
| Spacer layer (lower layer) | $\varepsilon_{2x} = \varepsilon_{2y} = \varepsilon_D\left(\frac{1+\alpha}{1-\alpha}\right)$ | $\varepsilon_{2x} = \varepsilon_{2y} = \varepsilon_D\left(\frac{1+\alpha}{1-\alpha}\right)$ |

TABLE 2-continued

| High impedance surface 100 | AMC 800, 900 |
|---|---|
| $\varepsilon_{2z} = \varepsilon_D - \frac{1}{\omega^2\varepsilon_o\mu_o\mu_D\frac{A}{4\pi}\left[\ln\left(\frac{1}{\alpha}\right)+\alpha-1\right]}$ | Same as High impedance surface 100 |
| $\mu_{2x} = \mu_{2y} = \frac{\varepsilon_D}{\varepsilon_{2x}}\mu_D$ | $\mu_{2x} = \mu_{2y} = \frac{\varepsilon_D}{\varepsilon_{2x}}\mu_D$ |
| $\mu_{2z} = (1-\alpha)\mu_D$ | $\mu_{2x} = (1-\alpha)\mu_D$ |

In Table 2, Y(ω) is an admittance function written in the second Foster canonical form for a one port circuit:

$$Y(\omega) = j\omega C_\infty + \frac{1}{j\omega L_o} + \sum_{n=1}^{N} \frac{1}{R_n + j\omega L_n + \frac{1}{j\omega C_n}}$$

This admittance function Y(ω) is related to the sheet capacitance ($C=\epsilon_{1t}\epsilon_o t$) of the FSS 802 of the AMC 800, 900 by the relation Y=jωC. The high impedance surface 100 has an FSS capacitance which is frequency independent. However, the AMC 800, 900 has an FSS 802 whose capacitance contains inductive elements in such a way that the sheet capacitance undergoes one or more Lorentz resonances at prescribed frequencies. Such resonances are accomplished by integrating into the FSS 802 the physical features of resonant loop structures, also referred to as artificial magnetic molecules. As the frequency of operation is increased, the capacitance of the FSS 802 will undergo a series of abrupt changes in total capacitance.

Figure 30:
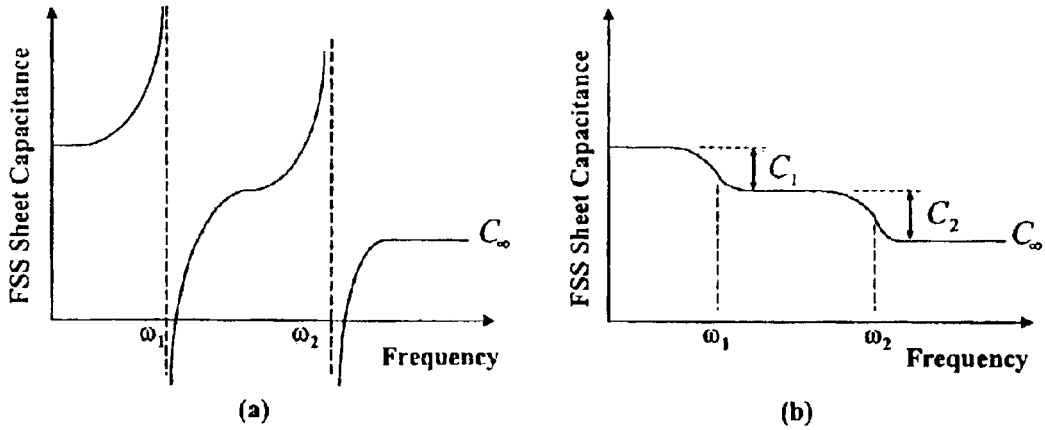
FIG. 30 illustrates Lorentz and Debye frequency responses for the capacitance of an FSS used in a multi-resonant AMC.

FIG. 30 illustrates sheet capacitance for the frequency selective surface 802 of the AMC 800 of FIG. 8 and the AMC 900 of FIG. 9. FIG. 30(*a*) shows that the capacitance of the FSS 802 is frequency dependent. FIG. 30(*b*) shows a Debye response obtained from a lossy FSS where $R_n$ is significant. In FIG. 30, two FSS resonances ($\omega_n=1/\sqrt{L_nC_n}$, N=2) are defined. The drop in capacitance across each resonant frequency is equal to $C_n$, the capacitance in each shunt branch of Y(ω). Although the regions of rapidly changing capacitance around a Lorentz resonance may be used to advantage in narrowband antenna requirements, some embodiments may make use of the more slowly varying regions, or plateaus, between resonances. This FSS capacitance is used to tune the inductance of the spacer layer 804, which is a constant, to achieve a resonance in the reflection coefficient phase for the AMC 800, 900. This multi-valued FSS capacitance as a function of frequency is the mechanism by which multiple bands of high surface impedance are achieved for the AMC 800, 900.

In contrast, the two-layer high impedance surface 100 will offer reflection phase resonances at a fundamental frequency, plus higher frequencies near where the electrical thickness of the bottom layer is nπ and n is an integer. These higher frequency resonances are approximately harmonically related, and hence uncontrollable.

A second difference in the tensor effective media properties for the high impedance surface 100 and AMC 800 is in the normal permeability component $\mu_{1n}$. The high impedance surface 100 has a constant $\mu_{1n}$, whereas the ATMC 800, 900 is designed to have a frequency dependent $\mu_{1n}$. The impedance function Z(ω) can be written in the first Foster canonical form for a one-port circuit.

$$Z(\omega) = j\omega L_\infty + \frac{1}{j\omega C_o} + \sum_{n=1}^{N} \frac{1}{G_n + j\omega C_n + \frac{1}{j\omega L_n}}$$

This impedance function is sufficient to accurately describe the normal permeability of the FSS 802 in an AMC 800, 900 regardless of the number and orientation of uniquely resonant artificial magnetic molecules.

The prior art high-impedance surface 100, whose FSS 102 is composed of metal patches, has a lower bound for $\mu_{1n}$. This lower bound is inversely related to the transverse permittivity according to the approximate relation $\mu_{1n}\approx 2/\epsilon_{1t}$. Regardless of the FSS sheet capacitance, $\mu_{1n}$ is anchored at this value for the prior art high-impedance surface 100. However, a normal permeability which is lower than $\mu_{1n}=2/_{1t}$ is needed to cut off the guided bound TE mode in all of the high-impedance bands of a multi-band AMC such as AMC 800 and AMC 900.

The overlapping loops used in the FSS 802 of the AMC 800, 900 allow independent control of the normal permeability. Normal permeabilities may be chosen so that surface wave suppression occurs over some and possibly all of the +/−90° reflection phase bandwidths in a multi-band AMC such as AMC 800 and AMC 900. The illustrated embodiment uses arrays of overlapping loops as the FSS layer 802, or in conjunction with a capacitive FSS layer, tuned individually or in multiplicity with a capacitance. This capacitance may be the self capacitance of the loops, the capacitance offered by adjacent layers, or the capacitance of external chip capacitors. The loops and capacitance are tuned so as to obtain a series of Lorentz resonances across the desired bands of operation. Just as in the case of the resonant FSS transverse permittivity, the resonances of the artificial magnetic molecules affords the designer a series of staircase steps of progressively dropping normal permeability. Again, the region of rapidly changing normal permeability around the resonances may be used to advantage in narrowband operations. However, the illustrated embodiment uses plateaus of extended depressed normal permeability to suppress the onset of guided bound TE surface waves within the desired bands of high-impedance operation.

In summary, the purpose of the resonance in the effective transverse permittivities $\epsilon_{1t}$ is to provide multiple bands of high surface impedance. The purpose of the resonances in the normal permeability $\mu_{1n}$ is to depress its value so as to prevent the onset of TE modes inside the desired bands of high impedance operation.

From the foregoing, it can be seen that the present embodiments provide a variety of high-impedance surfaces or artificial magnetic conductors which exhibit multiple reflection phase resonances, or multi-band performance. The resonant frequencies for high surface impedance are not harmonically related, but occur at frequencies which may be designed or engineered. This is accomplished by designing the tensor permittivity of the upper layer to have a behavior with frequency which exhibits one or more Lorentzian resonances.

While a particular embodiment of the present invention has been shown and described, modifications may be made. Other methods of making or using anisotropic materials with negative axial permittivity and depressed axial permeability, for the purpose of constructing multiband surface wave suppressing AMCs, such as by using artificial dielectric and magnetic materials, are extensions of the embodiments described herein. Any such method can be used to advantage by a person ordinarily skilled in the art by following the description herein for the interrelationship between the Lorentz material resonances and the positions of the desired operating bands. Accordingly, it is therefore intended in the appended claims to cover such changes and modifications which follow in the true spirit and scope of the invention.

What is claimed is:

1. An artificial magnetic conductor (AMC) resonant with a substantially zero degree reflection phase over at least two resonant frequency bands, the artificial magnetic conductor comprising a frequency selective surface characterized by a plurality of Lorentz resonant frequencies in transverse permittivity at independent, non-harmonically related, predetermined frequencies different from the resonant frequency bands, wherein the frequency selective surface has a transverse permittivity $\epsilon_{1t}$ defined by $$\varepsilon_{1x} = \varepsilon_{1y} = \frac{Y(\omega)}{j\omega\varepsilon_0 t},$$

wherein Y(ω) is a frequency dependent admittance function for the frequency selective surface, j is the imaginary operator, ω corresponds to angular frequency, $\epsilon_0$ is the permittivity of free space, and t corresponds to thickness of the frequency selective surface.

2. The AMC of claim 1 wherein the frequency selective surface has a normal permeability $\mu_{1z}$ defined by $$\mu_{1z} = \frac{Z(\omega)}{j\omega\mu_0 t},$$

wherein Z(ω) is a frequency dependent impedance function, j is the imaginary operator, ω corresponds to angular frequency, $\mu_0$ is the permeability of free space, and t corresponds to thickness of the frequency selective surface.

* * * * *